US008085260B2

(12) United States Patent
Derichs

(10) Patent No.: US 8,085,260 B2
(45) Date of Patent: Dec. 27, 2011

(54) SIMPLE MATRIX ADDRESSING IN A DISPLAY

(75) Inventor: Kevin Derichs, Buda, TX (US)

(73) Assignee: Rambus, Inc., Sunnyvale, CA (US)

( * ) Notice: Subject to any disclaimer, the term of this patent is extended or adjusted under 35 U.S.C. 154(b) by 0 days.

(21) Appl. No.: 12/820,003

(22) Filed: Jun. 21, 2010

(65) Prior Publication Data

US 2010/0302229 A1 Dec. 2, 2010

Related U.S. Application Data

(63) Continuation of application No. 10/529,114, filed as application No. PCT/US2004/037446 on Nov. 9, 2004, now Pat. No. 7,764,281.

(60) Provisional application No. 60/520,076, filed on Nov. 14, 2003.

(51) Int. Cl.
*G09G 5/00* (2006.01)

(52) U.S. Cl. ..... 345/211; 345/89; 345/204; 315/169.1

(58) Field of Classification Search ..... 345/89, 345/204, 211; 315/169.1
See application file for complete search history.

(56) References Cited

U.S. PATENT DOCUMENTS

| | | | |
|---|---|---|---|
| 3,937,876 | A | 2/1976 | Amsen et al. |
| 3,945,003 | A | 3/1976 | Borg et al. |
| 4,042,920 | A | 8/1977 | Harsch et al. |
| 5,319,491 | A | 6/1994 | Selbrede |
| 5,659,371 | A | 8/1997 | Krause |
| 5,719,590 | A | 2/1998 | Shimada et al. |
| 5,999,307 | A | 12/1999 | Whitehead et al. |
| 6,175,193 | B1 | 1/2001 | Kishita et al. |
| 6,307,663 | B1 | 10/2001 | Kowarz |
| 6,426,595 | B1 | 7/2002 | Odake et al. |
| 6,504,520 | B1 | 1/2003 | Osada et al. |
| 6,525,483 | B1 | 2/2003 | Van Gorkom et al. |
| 6,628,273 | B1 | 9/2003 | Rindal et al. |

(Continued)

FOREIGN PATENT DOCUMENTS

EP 0229647 A2 7/1987

(Continued)

OTHER PUBLICATIONS

Communication from the European Patent Office, "Supplementary European Search Report," Oct. 14, 2008 (265 pages).

*Primary Examiner* — Amare Mengistu
*Assistant Examiner* — Premal Patel
(74) *Attorney, Agent, or Firm* — Renner, Otto, Boisselle & Sklar, LLP

(57) ABSTRACT

An addressing mechanism for charging and discharging quasi-capacitive elements in an X-Y matrix. The addressing mechanism may be configured to toggle a resistor-capacitor (RC) time constant between large and small values such as by opening or closing a circuit path to a low impedance resistor disposed in parallel with a higher impedance in-line resistor. When this occurs, elements in the X-Y matrix can be addressed and controlled. The X-Y matrix may be comprised of multiple "rows" and "columns" of conductors where crosstalk may occur along the columns and rows. Crosstalk may be curtailed by using either hysteresis management or global control of the row's impedance along its entire length. The resulting control obviates the need for active devices at each matrix element to perform the switching functions.

12 Claims, 19 Drawing Sheets

U.S. PATENT DOCUMENTS

| | | | | |
|---|---|---|---|---|
| 6,653,997 | B2 | 11/2003 | Van Gorkom et al. | |
| 6,677,923 | B2 | 1/2004 | Kajihara et al. | |
| 6,956,332 | B2 | 10/2005 | Van Gorkom et al. | |
| 7,116,291 | B1 | 10/2006 | Suzuki et al. | |
| 2001/0033277 | A1* | 10/2001 | Sandoe et al. | 345/204 |
| 2002/0075251 | A1 | 6/2002 | Millman et al. | |
| 2002/0158859 | A1 | 10/2002 | Nakano et al. | |
| 2002/0167505 | A1* | 11/2002 | LeChevalier | 345/204 |
| 2003/0151577 | A1* | 8/2003 | Morita | 345/89 |

FOREIGN PATENT DOCUMENTS

| | | | |
|---|---|---|---|
| GB | 2308715 | | 2/1997 |
| JP | 56153687 | A | 11/1981 |
| JP | 62204233 | | 9/1987 |
| JP | 02195322 | A | 8/1990 |
| JP | 04229529 | A | 8/1992 |
| JP | 7104245 | A | 4/1995 |
| JP | 09120934 | A | 5/1997 |
| JP | 9179518 | A | 7/1997 |
| JP | 09281928 | A | 10/1997 |
| JP | 11297469 | A | 10/1999 |
| JP | 2000122611 | A | 4/2000 |
| JP | 2002149130 | A | 5/2002 |
| WO | WO-0015882 | A2 | 3/2000 |

* cited by examiner

High Impedance Charge Profile

Low Impedance Charge Profile

High Impedance Discharge Profile

Low Impedance Discharge Profile

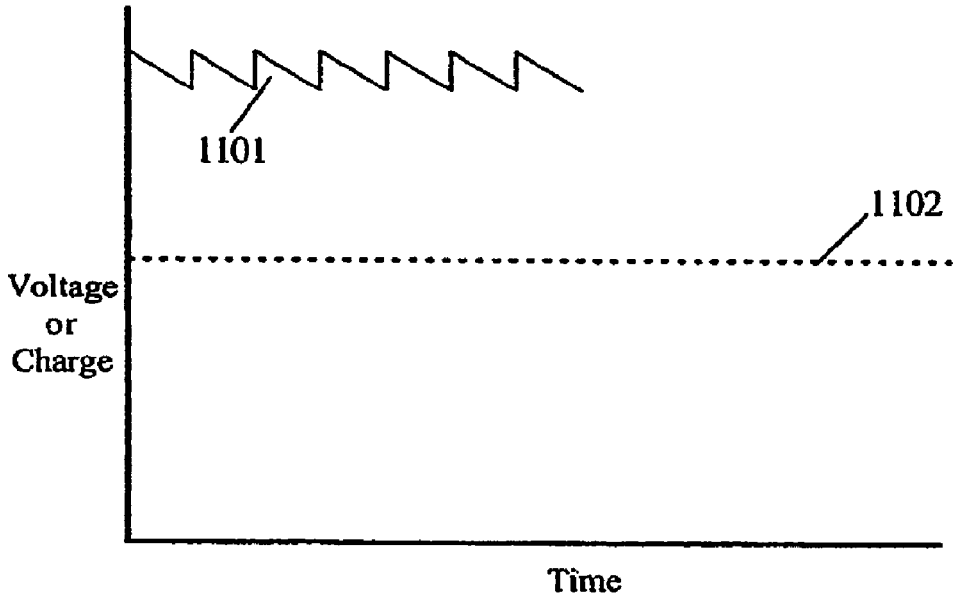
Continuous Mode: Charge every subcycle
(6 arbitrary subcycles shown for illustration)
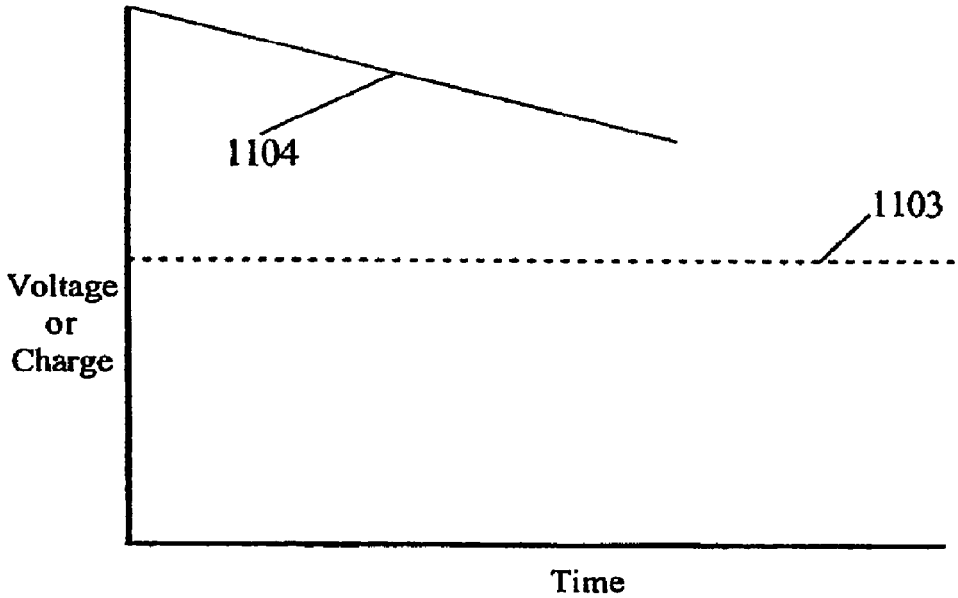
Burst Mode: Charge every cycle
(burst lasts for same 6 arbitrary sub-cycles as in continuous mode case above for illustration)
Figure 11

1301

| 330 | 331 |
|---|---|
| +V | -V |
| -V | +V |

1302

| Pixel State | Data 321 | PLC 334 | ROW 325 | CRD 333 | RRD 335 | 330 | 331 | COL 326 | ROW 313 |
|---|---|---|---|---|---|---|---|---|---|
| All pixels in active row blanked (OFF) | X | L | All L | H | H | +V | -V | Gnd | Gnd |
| All pixels in active row blanked (OFF) | X | L | All L | H | H | -V | +V | Gnd | Gnd |
| Intersecting pixel in active row Fast Charge (ON) | H | H | H | All L | All L | +V | -V | +V | -V |
| Intersecting pixel in active row Fast Charge (ON) | H | H | H | All L | All L | -V | +V | -V | +V |
| All pixels in active column Fast Charge (ON) | H | H | All H | All L | All L | +V | -V | +V | -V |
| Intersecting pixel in active row Slow change (OFF) | L | H | H | All L | All L | -V | +V | Gnd | +V |
| Intersecting pixel in active row Slow change (OFF) | L | H | H | All L | All L | +V | -V | Gnd | -V |
| All pixels in active column Slow change (OFF) | L | H | All H | All L | All L | +V | -V | Gnd | -V |
| All pixels hold previous state, Slow change | X | L | All L | All L | All L | +V | -V | Gnd | -V |
| All pixels hold previous state, Slow change | X | L | All L | All L | All L | -V | +V | Gnd | +V |
| State Not Allowed | H | H | H | H | H | -V | +V | Short to Gnd | |
| State Not Allowed | H | H | H | H | H | +V | -V | Short to Gnd | |

Figure 13

1401

| 436 | 437 |
|---|---|
| +V | -V |
| -V | +V |

1402

| Pixel State | CRD/ Logic 0 441 | Logic 1 412 | ROW 415 | RRD 440 | 436 | 437 | Col 429 | Row 425 |
|---|---|---|---|---|---|---|---|---|
| All pixels in active row blanked (OFF) | L | L | All L | H | -V | +V | Hi-Z | Gnd |
| All pixels in active row blanked (OFF) | L | L | All L | H | +V | -V | Hi-Z | Gnd |
| Intersecting pixel in active row Fast Discharge (OFF) | H | L | H | All L | +V | -V | Gnd | -V |
| All pixels Fast Discharge | All H | All L | All L | All H | +V | -V | Gnd | Gnd |
| All pixels Slow Discharge | L | H | All L | All H | -V | +V | -V | Gnd |
| Intersecting pixel in active row Fast Charge (ON) | L | H | H | All L | +V | -V | +V | -V |
| Intersecting pixel in active row Fast Charge (ON) | L | H | H | All L | -V | +V | -V | +V |
| All pixels in active column Fast Charge (ON) | L | H | All H | All L | +V | -V | +V | -V |
| All pixels hold previous state, Hi-Z | X | L | All L | All L | -V | +V | -V | +V |
| All pixels hold previous state, Hi-Z | X | L | All L | All L | +V | -V | +V | -V |
| State Not Allowed | H | H | H | H | -V | +V | Short to Gnd | Short to Gnd |
| State Not Allowed | H | H | H | H | +V | -V | Short to Gnd | Short to Gnd |
| State Not Allowed | H | H | H | All L | -V | +V | Short to Gnd | Short to Gnd |
| State Not Allowed | H | H | All H | All L | +V | -V | Short to Gnd | Short to Gnd |

Figure 14

1501

| C1 | C2 | C3 | C4 | 530 | 531 |
|---|---|---|---|---|---|
| L | H | L | H | +V | +V |
| H | L | L | H | -V | +V |
| L | H | H | L | +V | -V |
| H | L | H | L | -V | -V |

1502

| Pixel State | Data 521 | PLC 534 | ROW 525 | CRD 533 | RRD 535 | 530 | 531 | COL 526 | ROW 513 |
|---|---|---|---|---|---|---|---|---|---|
| All pixels in active row blanked (OFF) | X | L | All L | H | H | +V | +V | +V | +V |
| All pixels in active row (ON) | X | L | All L | H | H | -V | +V | +V | -V |
| All pixels in active row (ON) | X | L | All L | H | H | +V | -V | -V | +V |
| All pixels in active row blanked (OFF) | X | L | All L | H | H | -V | -V | -V | -V |
| Intersecting pixel in active row (OFF) | X | H | H | All L | All L | +V | +V | +V | +V |
| Intersecting pixel in active row (OFF) | X | H | H | All L | All L | -V | -V | -V | -V |
| Intersecting pixel in active row Fast Charge (ON) | H | H | H | All L | All L | +V | -V | +V | -V |
| Intersecting pixel in active row Fast Charge (ON) | H | H | H | All L | All L | -V | +V | -V | +V |
| All intersecting pixels in active Col Fast Charge (ON) | H | H | All H | All L | All L | +V | -V | +V | -V |
| Intersecting pixel in active row Slow change (OFF) | L | H | H | All L | All L | -V | +V | Gnd | +V |
| Intersecting pixel in active row Slow change (OFF) | L | H | H | All L | All L | +V | -V | Gnd | -V |
| All pixels in active column Slow change (OFF) | L | H | All H | All L | All L | +V | -V | Gnd | -V |
| All pixels hold previous state | X | L | All L | All L | All L | +V | +V | +V | -V |
| All pixels hold previous state | X | L | All L | All L | All L | -V | +V | -V | +V |
| All pixels hold previous state | X | L | All L | All L | All L | +V | -V | +V | -V |
| All pixels hold previous state | X | L | All L | All L | All L | -V | -V | -V | -V |
| All pixels in active row blanked (OFF) | H | H | H | H | H | +V | +V | +V | +V |
| State Not Allowed | H | H | H | H | H | -V | +V | STG | |
| State Not Allowed | H | H | H | H | H | +V | -V | STG | |
| All pixels in active row blanked (OFF) | H | H | H | H | H | -V | -V | -V | -V |

Figure 15

1601

| C1 | C2 | C3 | C4 | 636 | 637 |
|---|---|---|---|---|---|
| L | H | L | H | +V | +V |
| H | L | L | H | -V | +V |
| L | H | H | L | +V | -V |
| H | L | H | L | -V | -V |

1602

| Pixel State | CRD/ Logic 0 641 | Logic 1 612 | ROW 615 | RRD 640 | 636 | 637 | COL 629 | ROW 625 |
|---|---|---|---|---|---|---|---|---|
| All pixels in active row blanked (OFF) | L | L | All L | 1H | +V | +V | +V | +V |
| All pixels in active row blanked (OFF) | L | L | All L | 1H | -V | +V | -V | -V |
| All pixels in active row blanked (OFF) | L | L | All L | 1H | +V | -V | +V | +V |
| All pixels in active row blanked (OFF) | L | L | All L | 1H | -V | -V | -V | -V |
| Intersecting pixel in active row Fast Discharge | L | H | 1H | All L | +V | +V | +V | +V |
| Intersecting pixel in active row Fast Discharge | L | H | 1H | All L | -V | -V | -V | -V |
| Intersecting pixel in active row Fast Charge (ON) | L | H | 1H | All L | +V | -V | +V | -V |
| Intersecting pixel in active row Fast Charge (ON) | L | H | 1H | All L | -V | +V | -V | +V |
| All pixels in active row blanked (OFF) | H | L | 1H | All L | +V | +V | +V | +V |
| All pixels in active row blanked (OFF) | H | L | 1H | All L | -V | +V | +V | +V |
| All pixels in active row blanked (OFF) | H | L | 1H | All L | +V | -V | -V | -V |
| All pixels in active row blanked (OFF) | H | L | 1H | All L | -V | -V | -V | -V |
| Slow Charge, no activation | X | L | All L | All L | +V | +V | +V | +V |
| Slow Charge, no activation | X | L | All L | All L | -V | +V | -V | +V |
| Slow Charge, no activation | X | L | All L | All L | +V | -V | +V | -V |
| Slow Charge, no activation | X | L | All L | All L | -V | -V | -V | -V |
| Fast Change, no activation | L | H | All H | All L | +V | +V | +V | +V |
| All pixels in active Column Fast Charge (ON) | L | H | All H | All L | -V | +V | -V | +V |
| All pixels in active Column Fast Charge (ON) | L | H | All H | All L | +V | -V | +V | -V |
| Fast Change, no activation | L | H | All H | All L | -V | -V | -V | -V |
| All pixels in active row blanked (OFF) | H | H | 1H | 1H | +V | +V | +V | +V |
| State Not Allowed, | H | H | X | X | -V | +V | Short to Gnd | |
| State Not Allowed | H | H | X | X | +V | -V | Short to Gnd | |
| All pixels in active row blanked (OFF) | H | H | 1H | 1H | -V | -V | -V | -V |

Figure 16

Row Voltages, Column Voltages, and Resulting Differential Voltages at the crossover points of X-Y matrix

SIMPLE MATRIX ADDRESSING IN A DISPLAY

CROSS-REFERENCE TO RELATED APPLICATIONS

The present application is a continuation of co-pending, commonly assigned, U.S. patent application Ser. No. 10/529,114 entitled "SIMPLE MATRIX ADDRESSING IN A DISPLAY," filed Mar. 16, 2006, which itself is a 371 National Phase of International Application No. PCT/US2004/037446 filed Nov. 9, 2004, which application claims priority to and benefit of U.S. Provisional Application No. 60/520,076 filed Nov. 14, 2003, the disclosures of each of which are hereby incorporated herein by reference.

TECHNICAL FIELD

The present invention relates in general to the field of flat panel displays, and more particularly to any phased array system composed of constitutive elements that exhibit an activation threshold that, in conjunction with a sufficiently short cycle time, or optionally augmented by hysteresis management or other means, permits control through synchronized impedance and/or voltage articulation

BACKGROUND OF THE INVENTION

Flat panel displays, as representatives of a larger class of controllable devices, are comprised of a multiplicity of picture elements (pixels) usually arranged in an X-Y matrix. Different pixel designs lend themselves to different approaches to control individual pixels, which are often further broken down into red, green, and blue sub-pixels for most current display technologies, e.g., liquid crystal displays. Active matrix addressing currently involves the use of active devices (transistors, and more specifically, thin film transistors) at each subpixel to electrically control the display's pixels. The best-known alternative, passive matrix addressing, avoids the need for transistors distributed across the display by exploiting pixel latency (persistence) in those flat panel designs that admit of such manipulation. Passive matrix displays, while less expensive, are known to be of lower quality, and are not considered suitable for high resolution and/or video display applications with their high frame rates. Active matrix displays, while exhibiting better performance, are far more complex, more expensive to build, and suffer from poor yields at larger display sizes due to the large quantity of semiconductors (often numbering more than 3 million) distributed over the surface area of the display.

Therefore, there is a need in the art for a display addressing mechanism that combines the best features of active matrix and passive matrix addressing: high yields at larger display sizes, no active devices (transistors) on the display proper, high resolution capability, and high frame rates suitable for video imaging.

BRIEF SUMMARY OF THE INVENTION

The problems outlined above may at least in part be solved in some embodiments by controlling the local value of the resistive-capacitive time constant (hereafter "RC", denoting the arithmetic product RC, where R is resistance and C is capacitance) on the display screen. When RC is locally large, charge and discharge times are proportionally large. When RC is locally small, charge and discharge times are likewise small. RC can be controlled by adjusting the value of the in-line resistance, R. One straightforward way to adjust the value of the in-line resistance is to put a large resistance in parallel with a small resistance and a controllable switch. When the switch is open, current can only pass through the large resistance, yielding a large value for RC. When the switch is closed, current passes through both the small and large resistances, yielding a small value for RC. The switch, then, determines the value of R that predominates in determining the value of RC.

Certain species of a display (or other addressable system, such as a phased array system) have a sufficiently high frame rate (and correspondingly short signal cycle) that a locally high value for RC during a charge cycle is indistinguishable from the "off" condition, since the charging occurs too slowly to cause the device to locally activate e.g., a given pixel to activate. In like manner, a locally high value for RC during a discharge cycle extends the discharge time sufficiently as to be indistinguishable from a persistent "on" condition, since the discharge occurs too slowly to cause the device to locally deactivate during a given frame's duration. Even so, a mechanism to control crosstalk leakage between pixels along either rows or columns may well be required to attain adequately controlled persistence of the applied signal. Two distinct persistence-enhancing mechanisms are disclosed in the detailed description section to provide additional device persistence where needed. One persistence-enhancing mechanism is based on hysteresis management using multi-level voltage control. The other persistence-enhancing mechanism is based on row-level extension of the effective RC constant between pixels by separately controlling the resistance of the entire row in toto.

A locally low value for RC during a charge cycle yields a rapid turn-on cycle for the local device; during a discharge cycle, it yields a rapid turn-off for the local device. The system articulates impedances in an X-Y matrix geometry to attain control of devices at the intersections of the X and Y lines. Where implementation of persistence-enhancing mechanisms are indicated, one of two methods may be invoked. The first method, hysteresis management, may utilize two voltage levels on the rows and three voltage levels on the columns to ensure local signal persistence. Due to gauge independence, rows and columns can be treated interchangeably so far as the physical principles are concerned. As long as the device being activated satisfies certain requirements related to hysteretic behavior associated with key voltage combinations during a relevant system cycle, device persistence may adequately protect against crosstalk leakage. The second method involves shifting the effective resistance of the row across its entire length, using materials, e.g., certain doped perovskites, capable of large electrically-controlled shifts in resistance. The local RC value is thereby extended to the inter-pixel level, presenting a temporary barrier to charge leakage between pixels and thus "locking" the charge onto the pixels to provide intrinsic persistence during the relevant time cycle.

Devices that lend themselves to this addressing schema exhibit a time-sensitive activation-deactivation threshold that responds in the foregoing manner to the local manipulation of the capacitive time constant, RC. If the pixel device is addressed during every discretely addressable temporal subdivision of a primary color subframe (e.g., repeatedly at regular intervals during the red subcycle), the high RC state may provide inadequate time for the local pixel device to cross the activation threshold in either direction (charging or discharging) during that period. This requirement becomes more stringent if the pixel is addressed only during primary color subframe shifts (e.g., only one on-off event during the red subcycle), for the lengthened RC constant may still prevent the device from crossing the activation threshold in either direction (charging or discharging) during this longer time span (made up of a fixed integral series of discretely addressable temporal subdivisions of the primary color subframe).

In one embodiment of the present invention, an addressing mechanism comprises a first set of parallel, co-planar conductive control lines. The addressing mechanism may further comprise a second set of parallel, co-planar conductive control lines where the second set of conductive control lines are spaced apart in relation to the first set of conductive control lines. Further, a plane of the second set of conductive control lines is parallel to a plane of the first set of conductive control lines. Further, the control lines of the second set of conductive control lines are perpendicular to control lines of the first set of conductive control lines. The addressing mechanism may further comprise a row select mechanism configured to selectively apply an in-line impedance to a control lines of the first set of conductive control lines thereby enabling the toggling of the impedance between a low and a high value with respect to a determinate discharge path to ground. The addressing mechanism may further comprise a column select mechanism configured to selectively apply a drive voltage to each conductive line of the second set of conductive lines.

The foregoing has outlined rather broadly the features and technical advantages of one or more embodiments of the present invention in order that the detailed description of embodiments of the present invention that follows may be better understood. Additional features and advantages of embodiments of the present invention will be described hereinafter which form the subject of the claims.

BRIEF DESCRIPTION OF THE DRAWINGS

A better understanding of the present invention can be obtained when the following detailed description is considered in conjunction with the following drawings, in which:

FIG. 11 illustrates differences between continuous mode and burst mode driver schemas in accordance with an embodiment of the present invention;

FIG. 13 provides a full tabulation of inputs and outputs for the addressing mechanism disclosed in FIG. 3 in accordance with an embodiment of the present invention;

FIG. 14 provides a full tabulation of inputs and outputs for the addressing mechanism disclosed in FIG. 4 in accordance with an embodiment of the present invention;

FIG. 15 provides a full tabulation of inputs and outputs for the addressing mechanism disclosed in FIG. 5 in accordance with an embodiment of the present invention;

FIG. 16 provides a full tabulation of inputs and outputs for the addressing mechanism disclosed in FIG. 6 in accordance with an embodiment of the present invention;

DETAILED DESCRIPTION OF THE INVENTION

Figure 1:
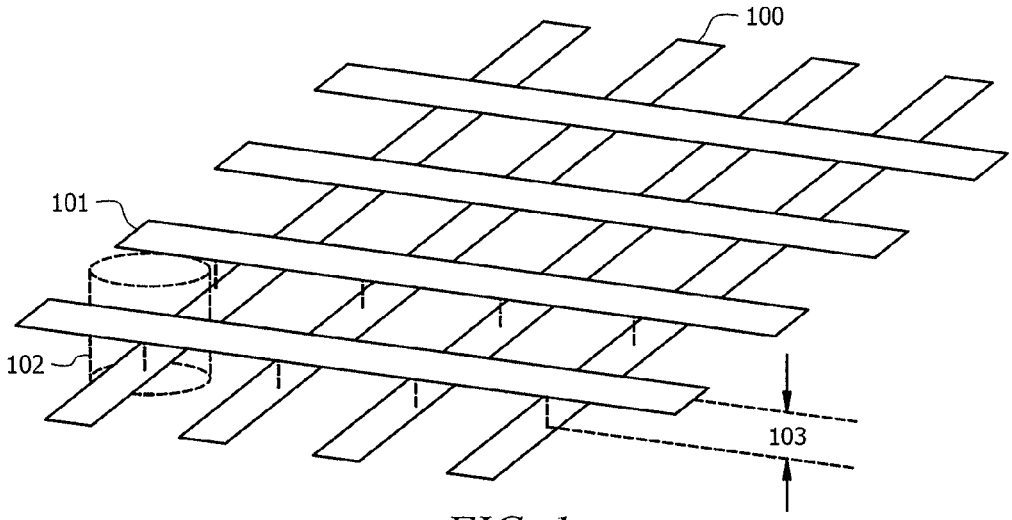
FIG. 1 illustrates a representative X-Y matrix system to be driven by any of the embodiments of the present invention.

Two different embodiments of the present invention are disclosed in the detail description section. In both embodiments, impedance control is exerted upon the rows of a matrix-addressable display, with the selected row exhibiting a low in-line impedance and unselected rows exhibiting high in-line impedances. State changes in the device occur on a selected row, while no effective stage changes are intended to occur on the remaining unselected rows. The driver system scans all the rows (presumably in sequence, although this is not an intrinsic requirement), re-articulating which row shall be the lone row exhibiting a low impedance value, then moving on to the next row to be so "selected," setting the previously selected row back into a high impedance state, and thereafter repeating this process cyclically for each row in the matrix. It should be understood that the terms "rows" and "columns" represent arbitrarily assigned labels to distinguish the two sets of lines that compose an X-Y matrix, and that the present invention does not rely on this distinction being anything other than relative. The use of either of the two disclosed persistence-enhancing methods may adjust this fundamental behavior to accommodate the exigencies of the method being invoked.

The two embodiments differ in their handling of the video data logic stream being fed to the columns, despite the articulated impedance row-select system they have in common. In the first embodiment, denoted the voltage-articulated column driver variant, incoming parallel data along the columns directly drives in-line column voltages in proportion to the incoming logic bits (whether 1 or 0). In one example, a bit value of 1 might correspond to a voltage of 5 volts, and a bit value of 0 might correspond to a grounded potential. In the second embodiment, denoted the impedance-articulated column driver variant, incoming parallel data along the columns directly drives in-line column impedances in reverse proportion to the incoming logic bits (whether 1 or 0). In one example, a bit value of 1 might correspond to a low in-line impedance, while a bit value of 0 might correspond to a high in-line impedance. In this second embodiment, a common voltage potential is applied to all columns during the cycle in question, with charging and discharging being manipulated entirely by combined row and column impedance values and a concomitant exploitation of the restricted span for the device's cyclical time domain in conjunction with the actuation/activation threshold of the device being controlled at a given X-Y crossover point in the matrix.

To summarize, the first embodiment manipulates voltages on the columns and impedances on the rows; the second embodiment manipulates impedances on both rows and columns.

A limited level of parallelism can further be imposed on both the row and column drivers to ensure system functionality with respect to extremely rapid addressing rates. It is possible to choose the smaller of the two matrix dimensions (whether X or Y) in terms of pixel count (pixels corresponding to the overlap of the X and Y control lines) and to subdivide the corresponding set of conductive traces into two sets of parallel traces. This may be done to provide electrical isolation between the two halves of the display or phased array system thus realized (perhaps best visualized by literally cutting the shorter dimension conductive traces in half, although in situ fabrication of the discontinuity may be the rule).

Assume an initial matrix of dimension 1,600 pixels by 1,200 pixels, corresponding to 1,600 columns of coplanar parallel conductive traces disposed in spaced apart relation to another set of 1,200 coplanar parallel rows of conductive traces, where the two planes in which the rows and columns are respectively situated are themselves parallel, with the rows oriented at right angle to the columns, thereby constituting a standard orthogonal matrix. The smaller dimension, 1,200, may be halved into two sets of 600. This may be achieved by cutting each of the 1,600 column traces (not the 1,200 row traces) in half. This serves to electrically isolate two sets of rows comprised of 600 rows each. Once electrically isolated, the two sets of row conductors can be addressed simultaneously and in parallel, such that two rows (one from each subregion) can be selected at once on the display without any form of parasitic crosstalk (not including intra-row inter-pixel crosstalk, which is addressed by the two persistence-enhancing mechanisms disclosed herein). Among other beneficial effects, this stratagem reduces the timing requirements for the overall system by a factor of two. Further parallelism by way of isolation can be achieved with the columns, and is not limited to a single halving as is the subdivision of the rows. The determining factor from the point of view of system timing is the single halving of the row addressing mechanism into two parallel systems.

The impedance-based embodiment, in the nature of the case, exhibits a negligible electromagnetic signature, and appreciable immunity to electromagnetic pulse attack due to the absence of Amperian loops.

With respect to the hysteresis management persistence-enhancing method, the prerequisite for implementing the hysteresis management method involves satisfaction of a critical relationship: the voltage needed to cause the pixel (or more generally, the device at an X-Y crossover point in the matrix) to activate ($V_{pull\text{-}in}$) is higher than the voltage needed to release the pixel ($V_{rel}$) back to its inactive state. Systems where this fundamental inequality holds (such as in the flat panel display device disclosed in U.S. Pat. No. 5,319,491) could be suitable candidates for this technique. The required behavior in the example provided is due, in this instance, to exigencies of electromechanical actuation of a parallel-plate capacitor system that lead to an instability point that causes device collapse—an effect that can be exploited by this persistence-enhancing method.

For systems that comply with the stated requirement, with sufficiently small time cycling, a 2+3 voltage level system (two voltage levels on columns, three voltage levels on rows) where eight explicit inequalities are satisfied may indeed provide adequate device persistence while controlling inter-pixel crosstalk leakage effects. The details of this hysteresis management system are disclosed in greater detail in the detailed description section of this disclosure.

With respect to the global row resistance control persistence-enhancing method, the prerequisite for implementing the global row resistance control method to attain device persistence with respect to a sufficiently short time cycle is the presence of a suitable material that can selectively alter its resistance. For example, certain doped perovskites are known to exhibit resistance swing factors up to $10^6$ upon application of a transverse electrical field across the material—such materials would be ideal candidates for the disclosed method. This material would either augment, or substitute for, the row conductors in the system, with an associated control mechanism synchronized to row selection trigger and release points. When the row goes into a high impedance state, this is effected across the entire substance of the row, such that the high R values appear between pixels on the same row, and not just where the row is connected to the impedance control mechanism, generally located beyond the X-Y matrix proper. This prevents inter-pixel crosstalk (by slowing down leakage between pixels) during the cycle of interest, thereby maintaining adequate device persistence until the row material is selectively switched back to its normal low-resistance state to permit discharge at the correct time.

In the following description, numerous specific details are set forth to provide a thorough understanding of the present invention. However, it will be apparent to those skilled in the art that the present invention may be practiced without such specific details. In other instances, well-known circuits have been shown in block diagram form in order not to obscure the present invention in unnecessary detail. For the most part, details considering timing considerations and the like have been omitted inasmuch as such details are not necessary to obtain a complete understanding of the present invention and are within the skills of persons of ordinary skill in the relevant art.

The principles of operation to be disclosed immediately below will assume the non-implementation of persistence-enhancing methods to clarify the fundamental behaviors being described. However, applications may require the implementation of at least one of the disclosed persistence-enhancing methods, in which event the more extended discussion, replete with the necessary elaborations, shall apply.

Among the technologies (flat panel display or other candidate technologies that require control of individual devices in a matrix configuration) that lend themselves to implementation of the present invention is the flat panel display disclosed in U.S. Pat. No. 5,319,491, which is hereby incorporated herein by reference in its entirety. The use of a representative flat panel display example throughout this detailed description shall not be construed to limit the applicability of the present invention to that field of use.

Figure 20:
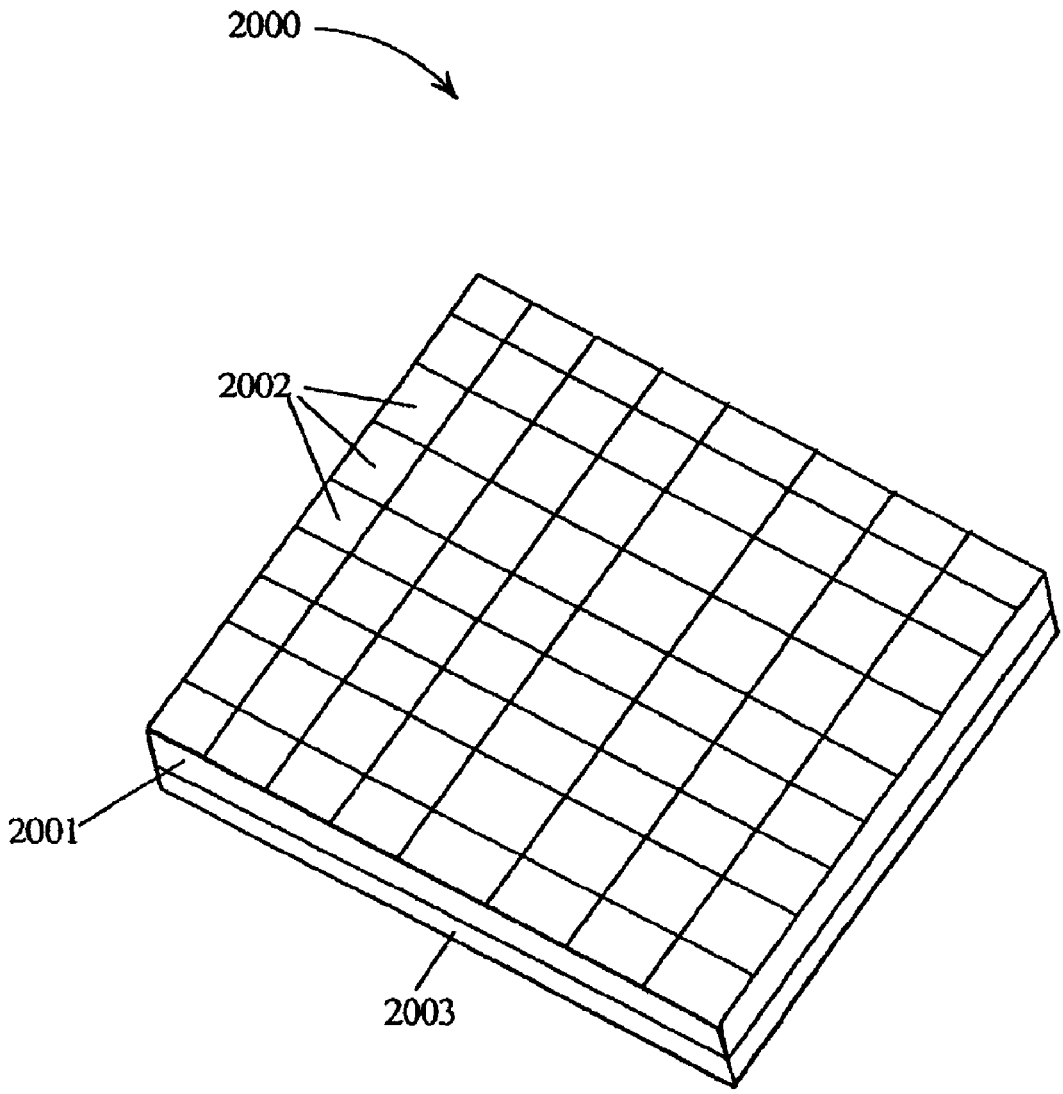
FIG. 20 illustrates a perspective view of a flat panel display in accordance with an embodiment of the present invention.

A flat panel display may comprise a matrix of optical shutters commonly referred to as pixels or picture elements as illustrated in FIG. 20. FIG. 20 illustrates a simplified depiction of a flat panel display 2000 comprised of a light guidance substrate 2001 which may further comprise a flat panel matrix of pixels 2002. Behind the light guidance substrate 2001 and in a parallel relationship with substrate 2001 may be a transparent (e.g., glass, plastic, etc.) substrate 2003. It is noted that flat panel display 2000 may comprise other elements than illustrated such as a tight source, an opaque throat, an opaque backing layer, a reflector, and tubular lamps, as disclosed in U.S. Pat. No. 5,319,491.

Figure 21A:
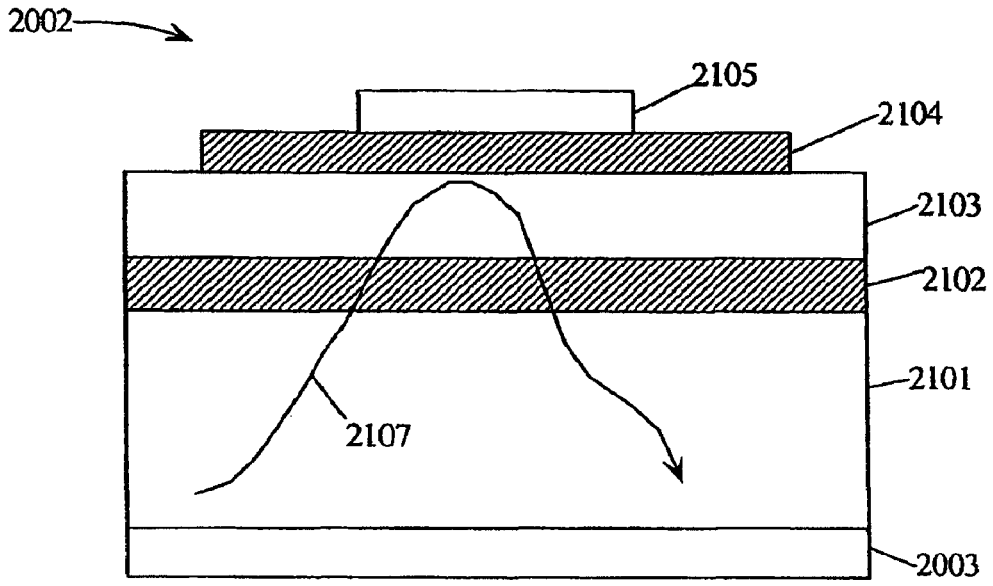
FIG. 21A illustrates a side view of a pixel in a deactivated state in accordance with an embodiment of the present invention.
Figure 21B:
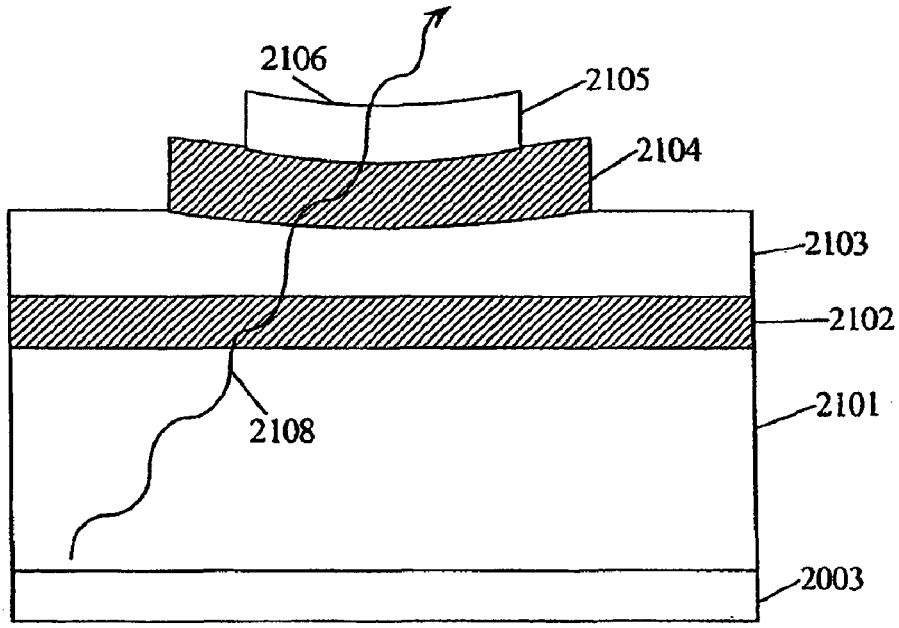
FIG. 21B illustrates a side view of a pixel in an activated state in accordance with an embodiment of the present invention.

Each pixel 2002, as illustrated in FIGS. 21A and 21B, may comprise a light guidance substrate 2101, a ground plane 2102, a deformable elastomer layer 2103, and a transparent electrode 2104.

Pixel 2002 may further comprise a transparent element shown for convenience of description as disk 2105 (but not limited to a disk shape), disposed on the top surface of electrode 2104, and formed of high-refractive index material, preferably the same material as comprises light guidance substrate 2101.

In this particular embodiment, it is necessary that the distance between light guidance substrate 2101 and disk 2105 be controlled very accurately. In particular, it has been found that in the quiescent state, the distance between light guidance substrate 2101 and disk 2105 should be approximately 1.5 times the wavelength of the guided light, but in any event this distance is greater than one wavelength. Thus the relative thicknesses of ground plane 2102, deformable elastomer layer 2103, and electrode 2104 are adjusted accordingly. In the active state, disk 2105 is pulled by capacitative action, as discussed below, to a distance of less than one wavelength from the top surface of light guidance substrate 2101.

In operation, pixel 2002 exploits an evanescent coupling effect, whereby TIR (Total Internal Reflection) is violated at pixel 2002 by modifying the geometry of deformable elastomer layer 2103 such that, under the capacitative attraction effect, a concavity 2106 results (which can be seen in FIG. 21B). This resulting concavity 2106 brings disk 2105 within the limit of the light guidance substrate's evanescent field (generally extending outward from the light guidance substrate 2101 up to one wavelength in distance). The electromagnetic wave nature of light causes the light to "jump" the intervening low-refractive-index cladding, i.e., deformable elastomer layer 2103, across to the coupling disk 2105 attached to the electrostatically-actuated dynamic concavity 2106, thus defeating the guidance condition and TIR Light ray 2107 (shown in FIG. 21A) indicates the quiescent, light guiding state. Light ray 2108 (shown in FIG. 21B) indicates the active state wherein light is coupled out of light guidance substrate 2101.

The distance between electrode 2104 and ground plane 2102 may be extremely small, e.g., 1 micrometer, and occupied by deformable layer 2103 such as a thin deposition of room temperature vulcanizing silicone. While the voltage is small, the electric field between the parallel plates of the capacitor (in effect, electrode 2104 and ground plane 2102 form a parallel plate capacitor) is high enough to impose a deforming force on the vulcanizing silicone thereby deforming elastomer layer 2103 as illustrated in FIG. 21B. By compressing the vulcanizing silicone to an appropriate fraction, light that is guided within guided substrate 2101 will strike the deformation at an angle of incidence greater than the critical angle for the refractive indices present and will couple light out of the substrate 2101 through electrode 2104 and disk 2105.

The electric field between the parallel plates of the capacitor may be controlled by the charging and discharging of the capacitor which effectively causes the attraction between electrode 2104 and ground plane 2102. By charging the capacitor, the strength of the electrostatic forces between the plates increases thereby deforming elastomer layer 2103 to couple light out of the substrate 2101 through electrode 2104 and disk 2105 as illustrated in FIG. 21B. By discharging the capacitor, elastomer layer 2103 returns to its original geometric shape thereby ceasing the coupling of light out of light guidance substrate 2101 as illustrated in FIG. 21A.

As stated in the Background Information section, certain devices that exhibit the appropriate activation threshold lend themselves to being driven using impedance articulation. A pertinent example that will be used throughout this disclosure to illustrate the operative principles in question is shown in FIG. 1, which sets forth one set of equidistant parallel conductive stripes 100 lying in a plane. Another set of equidistant parallel conductive stripes 101 lie in another plane that is in a spaced-apart parallel relation to the first plane, with the stripes 101 being at right angles to the stripes 100 of the first plane. Each crossover point between any individual member of the set of conductive stripes 100 and a corresponding individual member of the set of conductive stripes 101, such as conceptualized by the dotted cylindrical volume 102 and its counterparts, constitutes a threshold device governed by the actuation-charge relationship shown in FIG. 2. In this illustrative example, the crossover points in this particular X-Y matrix (such as the one defined by the cylindrical volume 102 in FIG. 1) behave as variable capacitors, given that relative motion between the orthogonally-disposed conductors can be induced by the Coulomb attraction between the positive charges on one conductor and the negative charges on the other. This local motion (deformation) causes the local distance 103 to decrease, thus increasing the capacitance in the vicinity of the crossover, e.g., region 102. The threshold for this composite architecture arises from the fact that the relative motion of the conductors traverses, in this example, an optically significant threshold for the device in question. This physical threshold would be the evanescent field described in U.S. Pat. No. 5,319,491, and referenced in that patent's FIGS. 16 and 17 (corresponding to FIGS. 21A and 21B of the present disclosure), which describe the active and inactive states of that device arising when high refractive index material in intimate contact with one conductive line is propelled into the evanescent field from an original quiescent position beyond the same evanescent field. The charge on the capacitor formed by the crossover of the respective conductors therefore exhibits an activation threshold due to the physical threshold (evanescent field) native to the device.

It should be understood that this optical example, proceeding from U.S. Pat. No. 5,319,491, is provided for illustrative purposes as a member of a class of valid candidate applications and implementations, and that any device, comprised of any system exhibiting the appropriate threshold behavior (mechanical, electrical, optical, or other interaction), can be present at, attached to, associated with, or driven by, the electrical effects being controlled at the crossover points of the X and Y matrix lines. Further, although the example provided uses ponderomotive force to put the device into an active state, it should be understood that the present invention is not limited to devices using such an activation mode. Finally, it should be understood that the conductive lines 100 and 101 that comprise the planar X-Y matrix, although usually oriented at right angles to one another, do not necessarily need to follow this constraint. The present invention governs the addressing of a large family of devices that meet certain specific activation criteria, while the specific reduction to practice of any particular device being so addressed imposes no restriction on the ability of the present invention to address and drive said device.

It should be further noted that while the electrical potential on any member of the conductive lines (100 or 101) assumes a single value, constituting it an equipotential surface, this does not in the least prevent charge accumulation to occur at the crossover points such as at cylindrical volume 102. Energy is stored in the electrical field that develops at these crossovers during the charging cycle. The charging cycle itself is characterized by the well-known relationship, $$q=CV(1-e^{-t/RC}) \quad \text{(Eq. 1)}$$

where q is accumulated charge, C is the capacitance of the cylindrical volume 102 arising between the conductive lines 100 and their orthogonal counterparts 101, e is the natural logarithm, V is the aggregate applied voltage, and R is the aggregate in-line resistance. While the potential V is applied to the system, the charge will accumulate until it reaches its asymptotic limit (the simple product CV, with the proviso that in some applications C may be variable due to variable gap between the conductive lines). Therefore, an equipotential surface is not inconsistent with localized charge accumulations distributed at determinate points along that surface.

Conversely, the discharging profile of the region 102 (upon removal of the drive voltage) is characterized by a complementary equation:

$$q=q_0e^{-t/RC} \quad \text{(Eq. 2)}$$

where $q_0$ is the original or initial charge present prior to the removal of the drive voltage.

A significance of the present invention is in its manipulation of the resistance R in Equations 1 and 2. Impedance articulation in effect changes the setting of the "spigot" that controls the rate at which charge enters or leaves the crossover region, which acts as a local quasi-capacitive system. If the spigot is wide open (low R), charge can accumulate quickly at the crossover point (different polarities, or more generally, different potentials, being present in the conductive lines 100 and their orthogonal counterparts 101). Low R always permits rapid attrition of accumulated charge to ground, or more generally, to the lowest potential difference when pathways to permit that equalization are made available. Conversely, high R restricts the aperture of the charge "spigot," so that charge accumulates at the crossover points (e.g., 102) very slowly. The rate of discharge is likewise restricted with high R.

Figure 2:
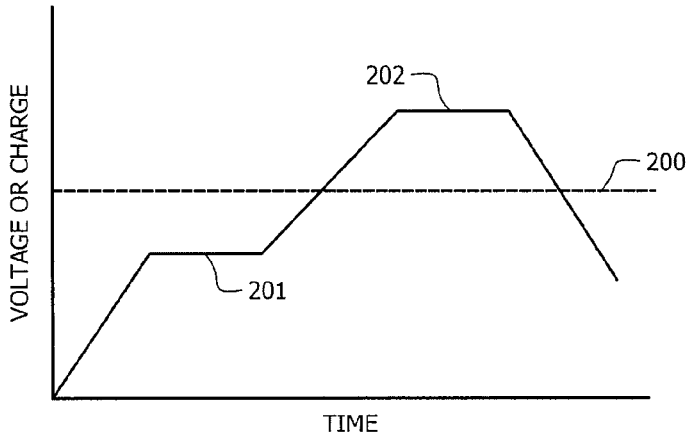
FIG. 2 illustrates the activation behavior of the individual devices in the X-Y matrix as a function of charge and time in accordance with an embodiment of the present invention.

FIG. 2 illustrates device behavior in a range suitable for implementation of the present invention. An activation threshold (the dotted line 200) represents a condition controlled directly or indirectly by the charge accumulated at the crossover region 102 of any given pair of conductors (one from the set of conductive rows 100 and the other from the set of conductive columns 102), such that the device is inactive if the charge is below 200, as would be the case at plateau 201, and is activated if the charge rises above 200, as is the case at plateau 202. The presence of plateaus of constant charge over time (viz, 201 and 202) is arbitrary: the traversal of the threshold 200 is the pivotal requirement for suitable driver candidates, not the shape of the curve that traverses that threshold, inclusive of the time before or after traversal. In one embodiment, columns 102 may be equally split into two collinear, coplanar halves with sufficient physical separation to ensure electrical isolation between them, which is more fully illustrated in FIG. 12.

Figure 3:
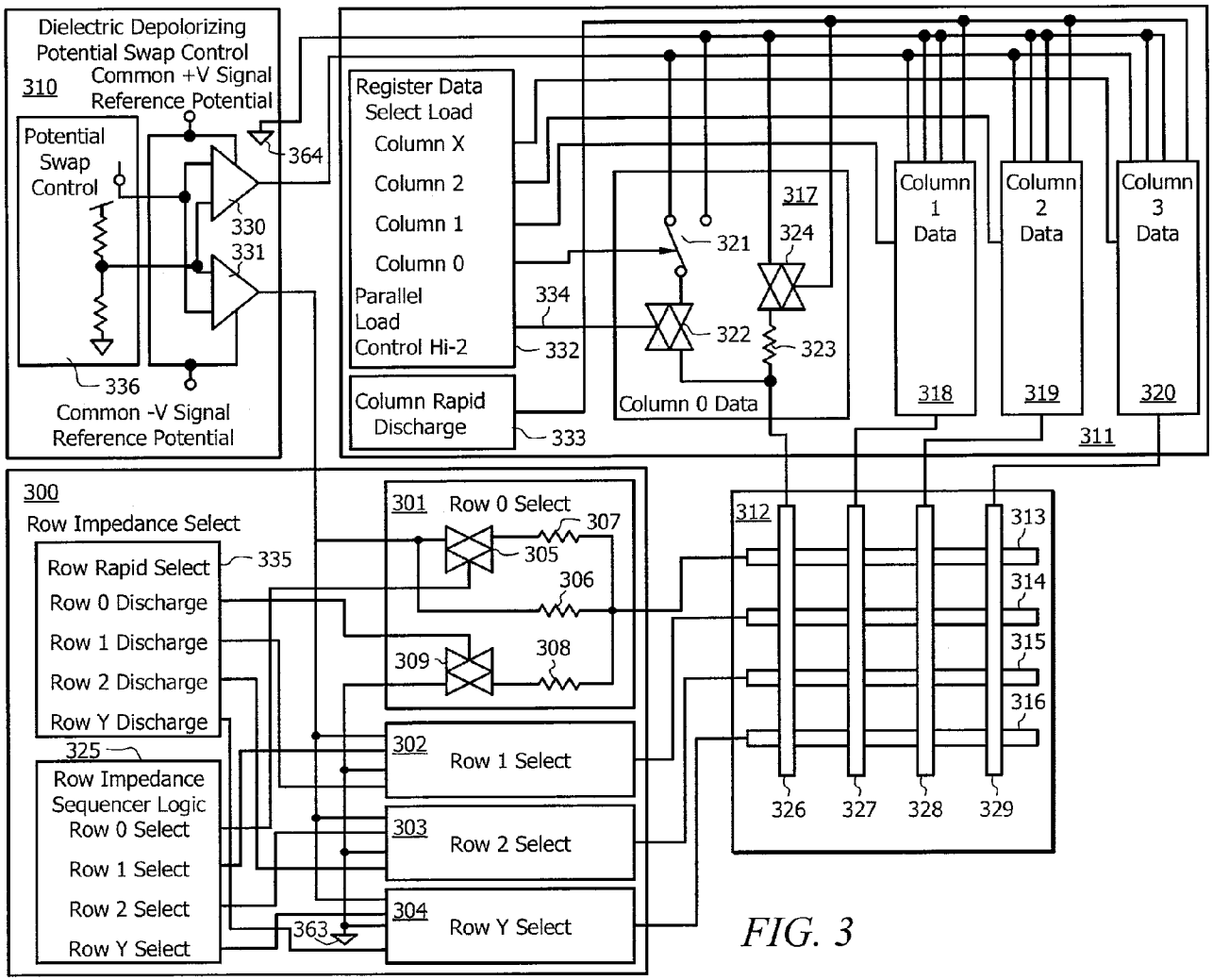
FIG. 3 illustrates a block logic breakdown of the voltage-articulated column driver embodiment incorporating an analog controlled dielectric depolarization and a common column rapid discharge mechanism in accordance with an embodiment of the present invention.

FIG. 3 illustrates one embodiment of the voltage-articulated embodiment of the present invention. In this embodiment, control of the crossover regions 102 from FIG. 1 are achieved by articulating the impedances of the rows to serve as a row select function while encoding activation data as high or low voltages on the columns. The set of parallel conductors visualized in FIG. 1 are replaced with their topological equivalents in FIG. 3, namely, the sixteen representative capacitors comprising the driven system in block 312. Four of these sixteen capacitors, corresponding to the arbitrary xth column (see Column X Data block 320) are labeled 313, 314, 315, and 316, each capacitor representing the crossover point of the xth (here the $4^{th}$) column with each of the rows. For illustrative purposes, the X by Y matrix is shown as a 4.times.4 matrix composed of the four physical column elements 326, 327, 328 and 329 (driven by column drivers 317, 318, 319, and 320, respectively) and the four row elements controlled by row impedance select subsystems 301, 302, 303, and 304, respectively.

Accordingly, capacitor 313 represents the crossover of the xth column 320 (physically designated by the associated conductive stripe 329) and row zero, labeled 301. As before, the reduction of the system to very small matrix dimensions (here, four rows and four columns, with the fourth item in each category being labeled the yth or xth iteration of its genus respectively) is intended to simplify the graphic presentation of the present invention. An actual device may well have thousands of rows and columns, all operating on the same principles that drive the smaller archetypal systems in FIG. 1, FIG. 3, FIG. 4, FIG. 5, FIG. 6 and FIG. 12.

The row select mechanism for the voltage-articulated embodiment of the present invention, so far as function is concerned, is nearly identical to the row select system for the impedance-articulated embodiment. What is said here with respect to this subsystem in FIG. 3 (namely, block 300) applies with equal validity to the same subsystem in FIG. 4 (namely, block 414). The row select mechanism in both figures operates as follows: a row select sequencer (325 in FIG. 3, 415 in FIG. 4) sequentially sends activation signals corresponding to the desired row select sequence, sending these signals according to a predetermined temporal schema tied to the appropriate system clock intrinsic to the device being driven (not shown). Such a sequence, for example, could be requests to activate rows 0, 1, 2, and Y, such requests being 0.5 microseconds apart (an arbitrarily chosen temporal value). Subsequent descriptions for the row select subsystem herein apply to both FIGS. 3 and 4, with the respective components referenced in that order as applied to their parent figure. The sequencer activates and closes a switch (305 or 420); prior to the closure of the switch, the low impedance resistor (307 or 421) was not in line (in parallel) with the high impedance resistor (306 or 422), yielding a net high resistance along the row. Upon the closing of the switch, the low impedance resistor (307 or 421) is placed in parallel with the high impedance resistor (306 or 422), thus dropping the total in-line resistance to below that of the low impedance resistor. Note that the high impedance in the circuit need not be achieved with a resistor, but can be acquired from the native behavior of a suitable device, e.g., transistor, or possibly even a non-device, e.g., an open circuit. In the same vein, the switching mechanism (305 or 420) should be regarded as generalized and not tied to any given electronic device: the functionality is normative, not the specific realization giving form to that functionality.

When Row 0 is selected (in a low impedance state), the other rows (1, 2, through Y) remain in a high impedance state. Only one row can be selected (in a low impedance state) at any time. The activation of the next row, Row 1, entails the deactivation of Row 0, meaning its switch (305 or 420) opens and the impedance for Row 0 goes high while Row 1 goes low. As the row sequencer advances to the next row, a "wave" of low impedance row selects propagates through all the rows in the system.

Figure 4:
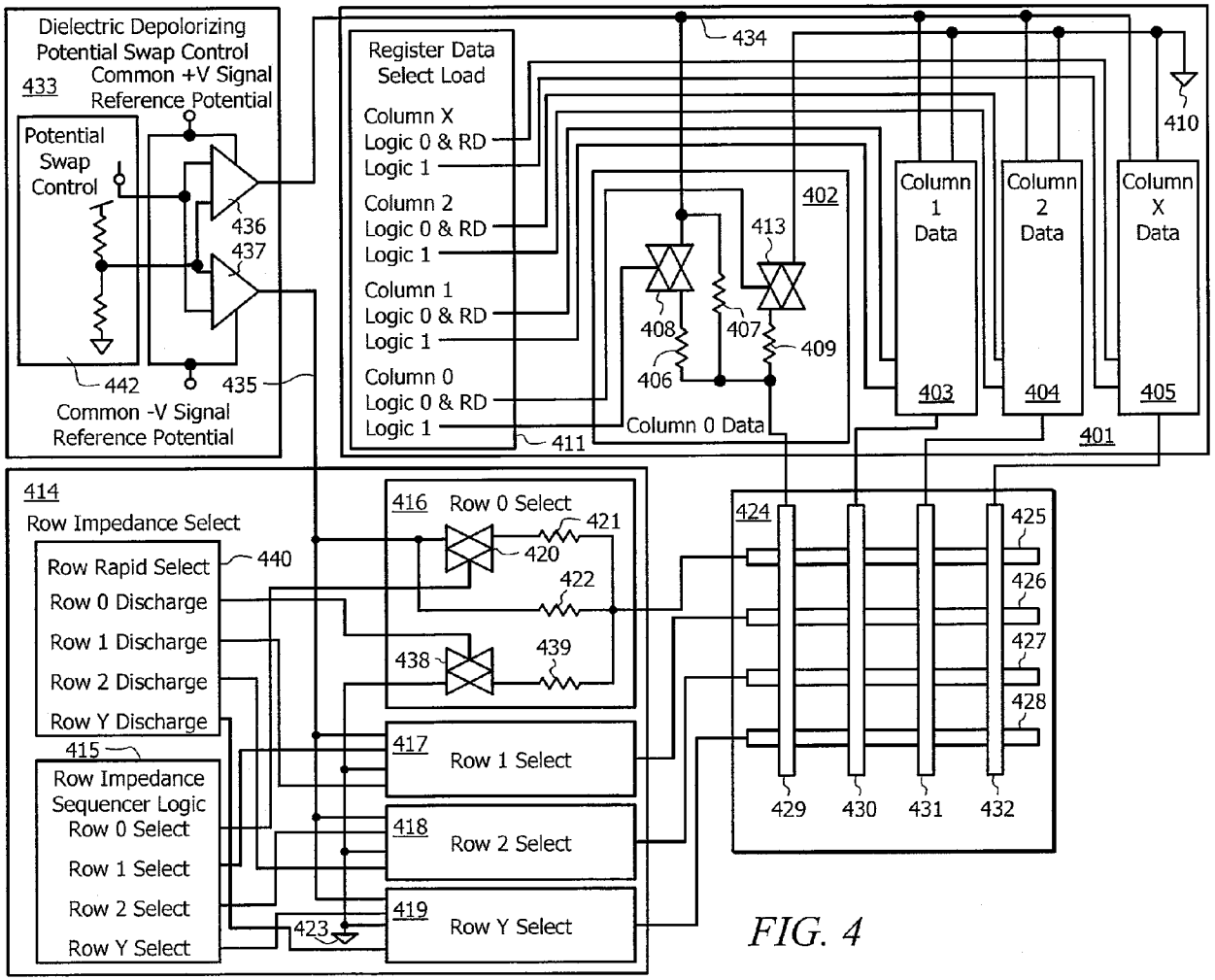
FIG. 4 illustrates a block logic breakdown of the impedance-articulated column driver embodiment of the present invention incorporating an analog controlled dielectric depolarization and an individual column rapid discharge mechanism in accordance with an embodiment of the present invention.

There is one exception to the rule concerning only one row at a time being permitted for selection, and this exception refers to a special case, denoted the "blanking cycle." The purpose of the blanking cycle Row Rapid Discharge (335 or 440) and Column Rapid Discharge (333 or 441) is to globally deactivate all devices by rapidly draining all electrical charge accumulated at the row-column crossover points to ground (shown in FIG. 3 as 363, shown in FIG. 4 as 423). This is controlled by the appropriate switching component (309 or 438) through the associated low impedance resistor (308 or 439), the analogs of which are replicated for all other rows as well (302, 303, 304 or 417, 418, 419). The charge is dissipated when the potential difference between the row and the column at the crossover point drops to zero, and the rate of dissipation is a function of in-line resistance. Global device deactivation requires that all rows and columns be set in a low impedance state to permit rapid discharge to ground (or equivalently, rapid potential equalization between affected rows and columns). The blanking cycle is commonly used to terminate a sequence of activations, such as would be the case in a display application when a given primary color cycle has ended. It is intended to quickly overcome and defeat the persistence of activated devices by globally reconfiguring the row and column impedances while rerouting the system for discharge to ground or to equalization of row and column potentials. For column subsystem 317, rapid discharge (low impedance paths to ground in both columns and rows) may be mediated by the signal fed to transistor 324 (or equivalent component), providing the "blanking state" heretofore described as discharge occurs through the low impedance 323 to ground 364. The entirety of the column driving mechanism, inclusive of the column drivers 402, 403, 404 and 405 in conjunction with the parallel data load system 411, constitutes the column drive system 401.

The sequential activation of rows 0, 1, 2, and Y by the impedance articulating subsystems (301, 302, 303, and 304 in FIGS. 3, 416, 417, 418, and 419 in FIG. 4) causes the impedance in the parallel co-planar conductors (313, 314, 315, and 316 in FIGS. 3, 425, 426, 427, and 428 in FIG. 4) to be in either a high or low state, as determined by the row selection sequencer.

The voltage-articulated embodiment illustrated in FIG. 3 encodes data in a subsystem 317 that directly ties an on-state (binary 1) to a non-zero voltage that is switched onto the column by way of an appropriate device, such as the switching component 321. Data comes into the appropriate column from a standard parallel load register system 332 that has a common high impedance control 334. The combined suite of column control subsystems 317, 318, 319, and 320 in conjunction with the column data register subsystem 332 and rapid discharge control for all columns 333 constitutes the entire row driver subsystem 311. An off-state (binary 0) ties to a zero voltage that is applied onto the respective column. The column voltages (whether zero or non-zero, for off and on states respectively) are applied simultaneously, in parallel (at transistor 322), and are synchronized with the row select sequencer (325), such that all the columns for row 0 are encoded and the voltages applied during the time row 0 (301) is selected (in a low impedance state). Although the same voltages along all columns are also present at the non-selected rows, the fact that those rows are in a very high impedance state curtails rapid charge accumulation, such that those particular column-row crossover points never traverse the threshold (200 in FIG. 2). The conjunction of a non-zero voltage and a low impedance row does, in fact, cause the device to traverse the activation threshold, turning the device associated with that X-Y crossover position on. The conjunction of a zero voltage and a low-impedance row causes no traversal of the activation threshold. In short, formal control over the behavior of all devices (e.g., pixels, or any other application being addressed thereby) during the time domain for the system is achieved hereby. The specifics of device operation are further analyzed in FIG. 7, FIG. 8, FIG. 9, and FIG. 10, which are explained further on. It is noted that when the impedance articulating subsystem is in the high impedance state, a cycle time for selectively charging and discharging the crossover region is sufficiently short such that an active device will not be deactivated and an inactive device will not be activated. For systems where this does not hold, one of the proposed enhancements (hysteresis management or global row resistance control) may need to be implemented to secure the required persistence relative to the cycle time. It is noted that when the impedance articulating subsystem is in a low impedance state, a cycle time for selectively charging and discharging the crossover region is sufficiently long such that an active device will discharge to below an activation threshold and an inactive device will charge beyond an activation threshold. It is further noted that the crossover region may include nonvarying capacitors or variable capacitors or other devices that are triggered by the electric field build-up between the rows and columns that are being controlled by the present invention. The case of variable capacitors applies to one notable application of the present invention, the device disclosed in U.S. Pat. No. 5,319,491.

Figure 5:
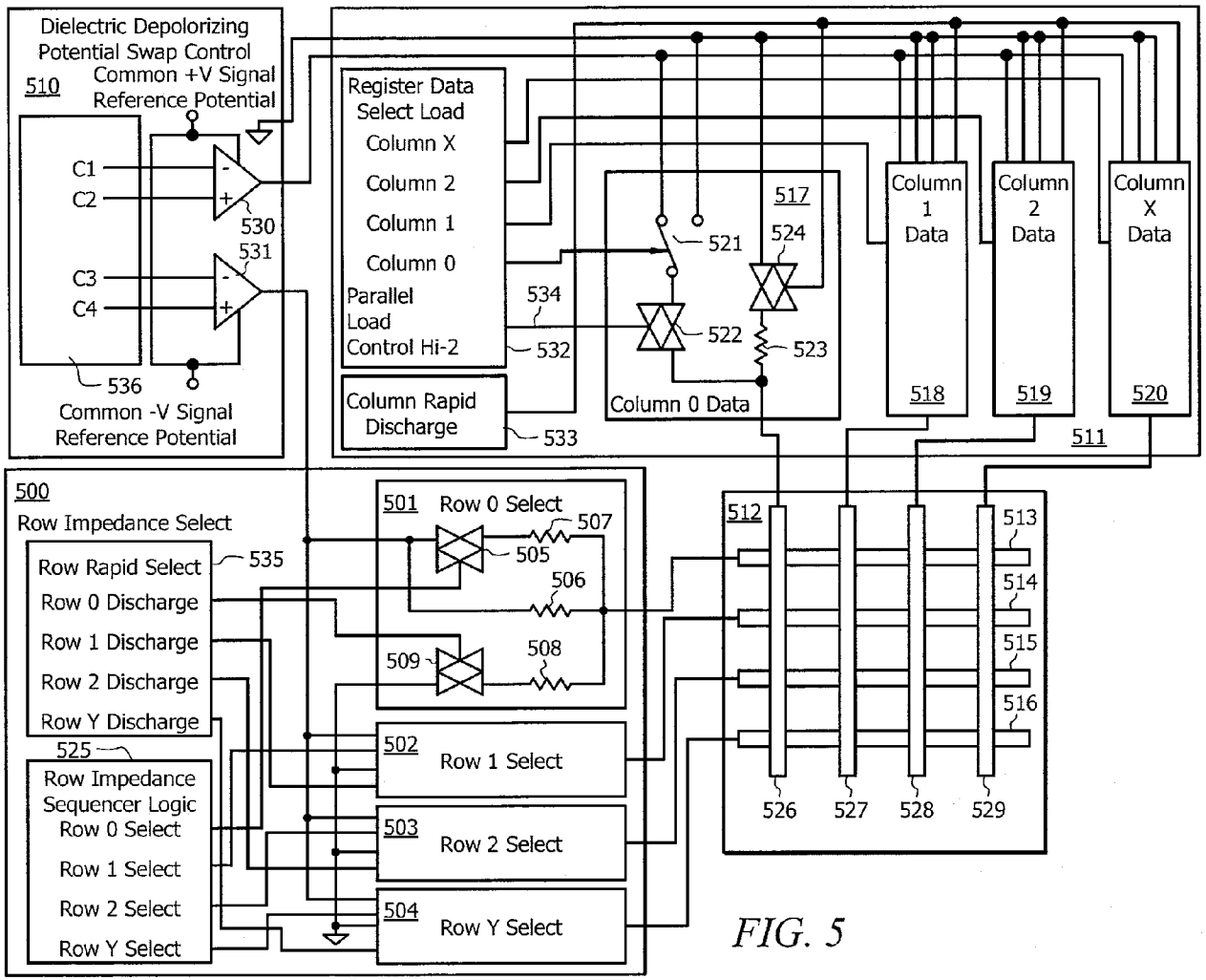
FIG. 5 illustrates a block logic breakdown of the voltage-articulated column driver embodiment of the present invention incorporating a logic controlled dielectric depolarization and a common column rapid discharge mechanism in accordance with an embodiment of the present invention.
Figure 6:
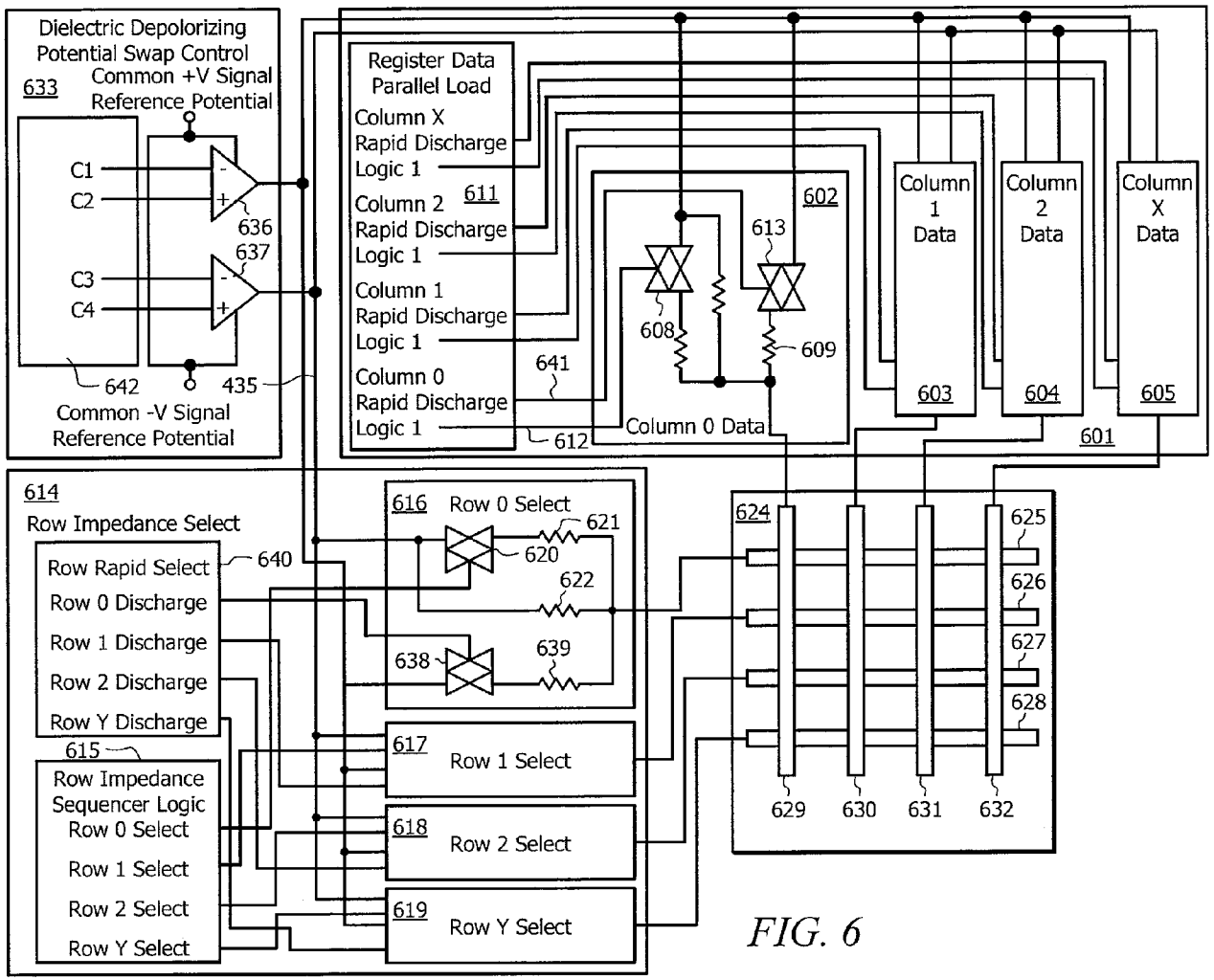
FIG. 6 illustrates a block logic breakdown of the impedance-articulated column driver embodiment of the present invention incorporating a logic controlled dielectric depolarization and an individual column rapid mechanism in accordance with an embodiment of the present invention.

Both FIG. 3 and FIG. 4 incorporate an optional enhancement module (310 and 433 respectively) designed to avoid the creation of a polarized dielectric in any intervening dielectric interposed between the two co-planar sets of conductors comprising the rows and columns (the orthogonal constituents of 312 and 424). In FIG. 5 and FIG. 6, the optional enhancement module (510 and 633 respectively) designed to avoid the creation of a polarized dielectric is controlled by the digital data in the Control Logic (536 and 642 respectively). Continued application of a unidirectional electric field through such a dielectric poses a potential risk of eventually polarizing the dielectric until it becomes an electret (although such effects are most commonly associated with temperatures ranging across the dielectric's Curie point). A known deleterious effect of such polarization is that the circuit will behave as if imperfectly shunted through a diode. To prevent the polarization of any dielectric material placed (by necessity or desire) between the co-planar sets of conductors, one can reverse the polarity of the field generated between the rows and columns on a regular and continuous basis (e.g., every subcycle, cycle, or determinate multiple of cycles). Modules 310 and 433 achieve this cyclical polarity swing by driving two comparators (330 and 331 in FIGS. 3, 436 and 437 in FIG. 4) from a voltage divider (336 in FIG. 3, 442 in FIG. 4) and oscillating swap control logic signal distributed across appropriate reference potentials of opposing polarity, as in the generalized topologies of 310 or 433. Modules 510 and 633 add extra control signals in logic modules 536 and 642 for determining the appropriate reference potentials. Selected by the control signals, the output of the two driving comparators (530 and 531 in FIG. 5, 636 and 637 in FIG. 6) can be set in one of four different configurations. Where polarization of an intervening dielectric is unlikely or harmless, the functionality of this module can be dispensed with.

What distinguishes the impedance-articulated embodiment of FIG. 4 from the voltage-articulated embodiment of FIG. 3 is that the incoming data on the columns is not encoded as voltage values. Rather, the parallel co-planar conductors 429, 430, 431, and 432 that comprise columns 0, 1, 2 and X are controlled in a very similar way to how the rows 425, 426, 427, and 428 are controlled: through impedance articulation. A similarity is that the rows are driven by a row select sequencer tied to a clock, such that only one row is selected (in a low impedance state) at any given point in time. The columns, however, are selected, not by a clock-driven sequencer, but by way of data encoding, initiated in block 411 and its associated components (note, for example, a representative pair of control points for the xth row, namely the combined logic zero and rapid discharge point 441 and the logic 1 point 412). The data for all the column impedance selection subsystems (402, 403, 404 and 405) is loaded simultaneously, in parallel. In the case of the representative subsystem 402, an ON state (binary 1) in the encoded data sets the switching component 408 such that the low impedance 406 is in parallel with the high impedance 407, creating a net low in-line impedance on that column. The switch in subsystem 402, namely 408, and its counterparts in subsystems 403, 404, and 405, serves to switch the path to the conductive columns between a negative reference potential or positive reference potential 434 generated by subsystem 433, which feeds one electrical potential to the columns via line 434 and a different electrical potential (usually of opposing polarity) to the rows via line 435. The potential difference is mediated by comparators 436 and 437 where polarization prevention for block 433 is enabled.

Whether or not the column is electrically tied to the negative reference potential or positive reference potential 434, its behavior will be determined ultimately by the setting of the switching component 408, due to the fact that the column 429 joins the column impedance select subsystem 402 by being tied between the low and high impedances 406 and 407. The state of switching component 408 determines whether or not the low impedance 406 is truly in parallel with the high impedance 407. There is a synchronized coordination of common behavior to all columns, arbitrated by the switching component 408 and its counterparts, and column-specific behavior determined by the incoming data being encoded. Rapid discharge (low impedance paths to ground in both columns and rows) is mediated by the signal fed to transistor 413 (or equivalent component) and its correlates, providing the "blanking state" heretofore described.

A difference between FIG. 3 and FIG. 5 lies between respective blocks 310 and 510; in all other particulars, the two topologies are identical. More specifically, subsystem 511 is equivalent to 311, with parallel logic system 532 equivalent to 332; the four column controllers 517, 518, 519, and 520 correspond to the analogous drivers 317, 318, 319 and 320; the detailed components of representative column controller 517 correspond to their counterparts in 317, such that switch 521 is equivalent to 321, low impedance resistor 523 is equivalent to 323, and switching components 524 and 522 correspond exactly with 324 and 322, respectively. Additionally, the parallel load control for the high impedance state 534 is equivalent to 334, while the column rapid discharge control 533 corresponding precisely with the equivalent control 333. The physical column structures 526, 527, 528 and 529 correspond to the equivalent structures 326, 327, 328 and 329, while the capacitors represented by the X-Y crossover points 513, 514, 515 and 516 correspond directly to the equivalent elements 313, 314, 315 and 316. Therefore, the entire X-Y subsystem 512 is identical in construction to 312. The row selection system 500 is identical to 300, such that the rapid row discharge control 535 is equivalent to 335, the row impedance sequencer logic system 525 is equivalent to 325, and each of the row select subsystems 501, 502, 503, and 504 correspond to their respective counterparts 301, 302, 303, and 304. Finally, the individual components of any given row select subsystem in FIG. 5 matches its counterparts in FIG. 3, such that the low impedance charge resistor 507 is equivalent to 307, the high impedance charge resistor 506 is equivalent to 306, the low impedance discharge resistor 508 is equivalent to 308, and the respective transistors for selection and discharge (505 and 509) are equivalent to their respective counterparts (305 and 309).

A difference between FIG. 4 and FIG. 6 lies between respective blocks 433 and 633; in all other particulars the two topologies are identical. More specifically, subsystem 601 is equivalent to 401, with parallel logic system 611 equivalent to 411; the four column controllers 602, 603, 604, and 605 correspond to the analogous drivers 402, 403, 404 and 405; the detailed components of representative column controller 602 correspond to their counterparts in 402, such that the high impedance resistor 607 is equivalent to 407, low impedance charging resistor 606 is equivalent to 406, low impedance discharging resistor 609 is equivalent to 409, and switching components 608 and 613 correspond exactly with 408 and 413, respectively. The subcomponents of 611 correlate precisely with their counterparts in 411, such that column 0 rapid discharge control 641 corresponds to 441 while logic 1 control 612 corresponds with 412. The physical column structures 629, 630, 631 and 632 correspond to the equivalent structures 429, 430, 431 and 432, while the capacitors represented by the X-Y crossover points 625, 626, 627 and 628 correspond directly to the equivalent elements 425, 426, 427 and 428. Therefore, the entire X-Y subsystem 624 is identical in construction to 424. The row selection system 614 is identical to 414, such that the rapid row discharge control 640 is equivalent to 440, the row impedance sequencer logic system 615 is equivalent to 415, and each of the row select subsystems 616, 617, 618, and 619 correspond to their respective counterparts 416, 417, 418, and 419. Finally, the individual components of any given row select subsystem in FIG. 6 matches its counterparts in FIG. 4, such that the low impedance charge resistor 621 is equivalent to 421, the high impedance charge resistor 622 is equivalent to 422, the low impedance discharge resistor 639 is equivalent to 439, and the respective transistors for selection and discharge (620 and 638) are equivalent to their respective counterparts (420 and 438).

Blocks 310 and 433 use analog means to achieve potential control, whereas blocks 510 and 633 achieve the same goal digitally, based on the logic signals sent to the comparators (530 and 531 in FIG. 5; 636 and 637 in FIG. 6). The truth tables that codify the behavior of the systems disclosed in FIGS. 3, 4, 5 and 6 are provided in FIGS. 13, 14, 15 and 16, respectively. For the sake of referential clarity, the truth tables in FIGS. 13, 14, 15 and 16 make back reference to putative points in the topologies using the actual numerical annotations thereunder; such references to the base topologies of FIGS. 3, 4, 5, and 6 appear italicized in FIGS. 13, 14, 15, and 16, respectively. Each of these figures is composed of two sections: a smaller table specifying the electrical state of the referenced element (as in 1301, 1401, 1501, and 1601, which provide the set of legitimate permutations for the devices illustrated in FIGS. 3, 4, 5, and 6, respectively), and an associated larger table explicating the dynamic state changes entailed by the driving process under conditions satisfied at the referenced component (as in 1302, 1402, 1502, and 1602, which provide detailed background information on the legitimate states arising in the devices illustrated by FIGS. 3, 4, 5, and 6, respectively). The abbreviation CRD stands for Column Rapid Discharge, while RRD stands for Row Rapid Discharge, referring to the processes actuated by the respective blocks consonant with the preceding discussion.

The nature of these correlated behaviors can be illustrated by way of example. It is important to note that charges can only accumulate at a column-row crossover point if the row is selected (in a low impedance state)—otherwise, the long charging time bars the crossover from traversing the threshold point until after the pertinent cycle has already terminated. Therefore, no activation will occur on non-selected rows during the time frame in question. In that light, consider the following sequence of events. When it is time to encode the data onto the columns, all rows will be in the high impedance state, according to the determinate state of component 420 and its counterparts, at which point the component 408 is toggled to place the voltage potential from line 434 onto the column. As each subsequent row is selected (switched to a low impedance state), the corresponding column data for that row is loaded in parallel (simultaneously) and encoded at component 408 and its counterparts. Rows already processed remain in their encoded state (above or below the threshold of activation) at the crossover points due to the high in-line impedance that slows charging and discharging (whether through its native properties, or as enhanced by one of the optional inter-pixel crosstalk-inhibiting mechanisms to improve device persistence disclosed farther down).

The bi-directional control device 413 and its counterparts will permit rapid discharge through low impedance 409 to ground. The conjunction of low impedances on both rows and columns with clear paths to equalized (or grounded) potentials provide the necessary conditions for rapid deactivation of all components within the column-row array.

The fundamental differences between the voltage-articulated embodiment and the impedance-articulated embodiment can now be summarized. The two embodiments differ in their handling of the data logic stream being fed to the columns 100, despite the articulated impedance row-select system they have in common. In the voltage-articulated column driver embodiment, incoming parallel data along the columns 100 directly drives in-line column voltages in proportion to the incoming logic bits (whether 1 or 0). In one example, a bit value of 1 might correspond to a voltage of 5 volts, and a bit value of 0 might correspond to a grounded potential.

In the impedance-articulated column driver embodiment, incoming parallel data along the columns 100 directly drives in-line column impedances in reverse proportion to the incoming logic bits (whether 1 or 0). In one example, a bit value of 1 might correspond to a low in-line impedance, while a bit value of 0 might correspond to a high in-line impedance. In this embodiment, a common voltage potential is applied to all columns 100 during the cycle in question, with charging and discharging being manipulated entirely by combined row and column impedance values and a concomitant exploitation of the restricted span for the device's cyclical time domain in conjunction with the actuation/activation threshold of the device.

Figure 7:
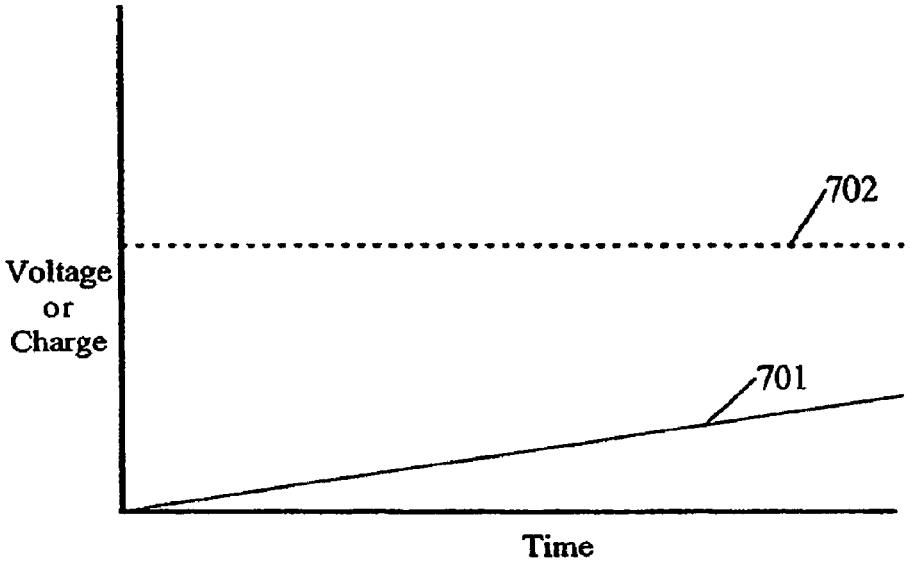
FIG. 7 illustrates a charging profile for a high-impedance state in accordance with an embodiment of the present invention.

The respective behaviors under charging and discharging scenarios are illustrated in FIG. 7, FIG. 8, FIG. 9, and FIG. 10. FIG. 7 discloses the charging profile when either a row, or a row plus a column, are in a high impedance state. Although the crossover point is indeed charging, the accumulation of charge 701 builds up so slowly that during the relevant time cycle, it never traverses the activation threshold 702. This is tantamount to an off-state, so long as the time cycle, or time domain, is sufficiently short that the threshold 702 is not traversed. Although the profile 701 is shown as a straight line (in this figure and in the three following), this is for ease of illustration. Actual charging and discharging profiles exhibit well-known curvatures in keeping with the equations (such as, in the simplest cases, Eq. 1 or Eq. 2 hereof) that govern these electrical phenomena, which are disclosed in more detail below.

Figure 8:
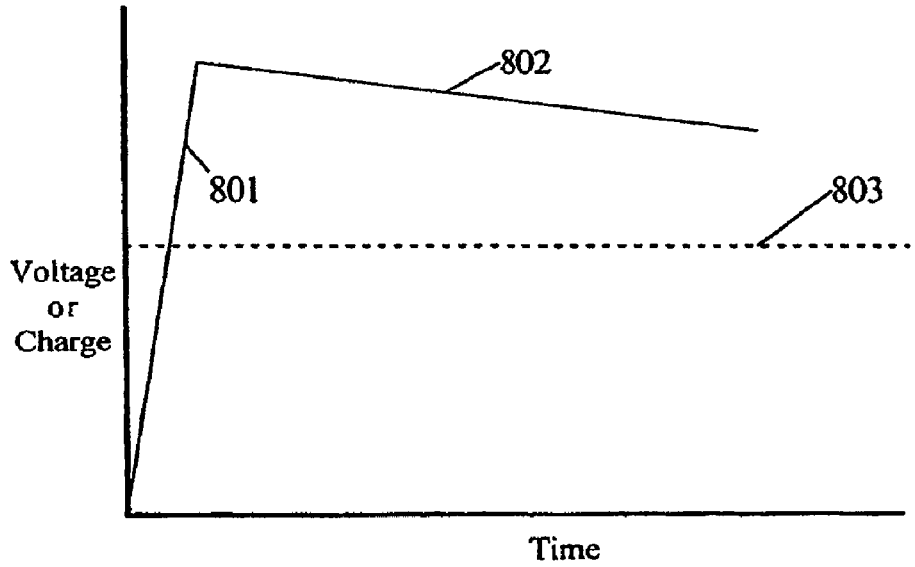
FIG. 8 illustrates a charging profile for a low-impedance state in accordance with an embodiment of the present invention.

FIG. 8 illustrates a rapid charge profile 801 that quickly traverses the activation threshold 803. At that point, the system is placed in a high impedance state and the gentle discharge 802 starts to slowly move back to the threshold point. So long as the cycle ends before 802 traverses the threshold as the discharge progresses, the "persistence" of the activation is insured.

Figure 9:
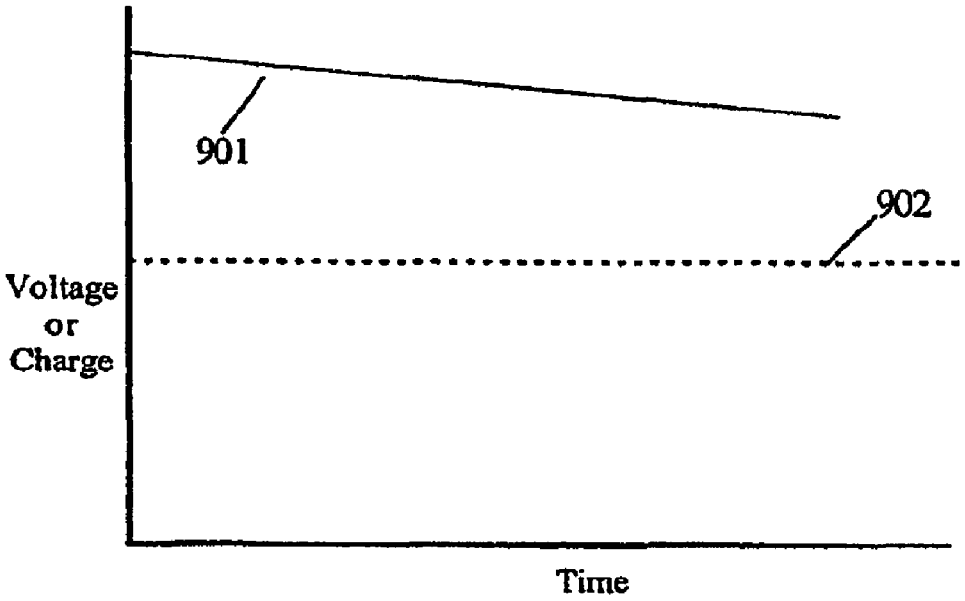
FIG. 9 illustrates a discharging profile for a high-impedance state in accordance with an embodiment of the present invention.

FIG. 9 illustrates a high impedance discharge profile 901 slowly approaching the activation threshold 902. If the charge should drop below the activation threshold, the device associated with the column-row crossover point will itself be deactivated. FIG. 9 reiterates what has already been previewed in FIG. 8 with respect to the discharge curve 802 that is a concomitant of an imposed high impedance state. That state can be imposed by an event as simple as the toggling to the next row, putting the current row into a high impedance state. It should be noted that the timing requirements to keep active devices, e.g., pixels or other devices being addressed and controlled at the row-column crossover points, on (and inactive devices off) may have to factor in the time it takes to select all rows in sequence, and the time allotted for the selection of a row may be sufficiently long to permit, for some applications, some level of pulse width modulation. A mechanism for reducing the high speed processing times to satisfy these conflicting criteria is disclosed below.

Figure 10:
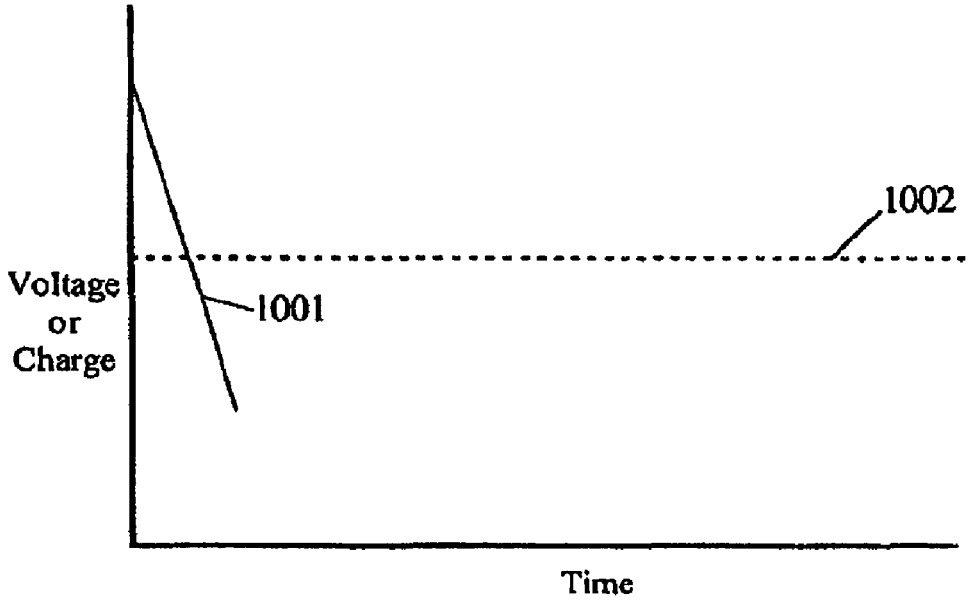
FIG. 10 illustrates a discharging profile for a low-impedance state in accordance with an embodiment of the present invention.

FIG. 10 illustrates a rapid discharge during a low impedance state, where the voltage drops to a value 1001 below the threshold for activation 1002. This kind of discharge would also be associated with the blanking state described earlier. The term discharge may refer to an attenuation of the electric field at the crossover points between a given row and column, due to equalization of the potential between them. This may be the case when rows and columns are shorted to ground and discharged through low impedance pathways, but the present invention can be generalized to more elaborate constructs, including those with floating grounds.

There are two different drive techniques available during the charging cycle. The first technique, denoted "continuous mode drive," involves repeatedly applying the drive voltage during temporal subdivisions of the fundamental primary period. This may be appropriate if the accumulated charge, even in a high R state, should fall below the activation threshold for the device during the primary period. Like the juggler spinning plates on poles who continuously imparts additional spin to the plates to keep them from falling, some configurations of the present invention may require continuous "refreshing" of the applied voltage to keep a given crossover point in an active state, well above the deactivation threshold. This is illustrated in charging profile 1101 of FIG. 11: the charge is repeatedly applied to prevent the device from traversing below the activation threshold 1102, resulting in the sawtooth pattern illustrated. In this example, six subcycles make up the entire desired duration for activation, corresponding to the six teeth of the profile, each with its own brief discharge component arcing down toward the threshold 1102 but never being permitted near that point.

On the other hand, if the primary period is short relative to the discharge time, such continual refresh cycles may be unnecessary. This mode, denoted "burst mode drive," applies the voltage once per cycle rather than continuously for each subcycle (determinate subdivisions of the fundamental cycle). The profile 1103 in FIG. 11 illustrates the same situation as in profile 1101, except that the six subcycle duration is achieved by a single activation, with the device discharging in a high impedance state during that time frame without reaching, let alone traversing, the threshold 1104.

The present invention incorporates both of these driver strategies by explicit reference.

One can quantify the suitability ranges for the two different driver strategies illustrated in FIG. 11 based on knowledge of the activation threshold, which, since it is linearly related to the accumulated charge in the device, can be denoted as $q_{threshold}$. The set of relationships is tabulated in Table 1 below, where $T_{cycle}$ represents the determinate length of time for a fundamental cycle and $T_{subcycle}$ is the length of time for a predetermined subdivision of the fundamental cycle. The term R throughout Table 1 refers to resistance in the high impedance state. It is assumed that response for the low impedance state is sufficiently fast for device activation, meaning that Table 1 propounds a specification floor in terms of device persistence.

TABLE I

| | |
|---|---|
| $CVe^{Tcycle/RC} > q_{threshold} > CV(1 - e^{-Tcycle/RC})$ | Burst or Continuous |
| $CV(1 - e^{-Tcycle/RC}) > q_{threshold} > CV(1 - e^{-Tsubcycle/RC})$ AND $CVe^{-Tsubcycle/RC} > q_{threshold}$ | Continuous Only |
| $qthreshold < CV(1 - e^{-Tsubcycle/RC})$ OR $CVe^{-Tsubcycle/RC} < q_{threshold}$ | Untenable Configuration |

The advantage of burst mode lies in the reduced bandwidth to operate the addressing system, but not all applications lend themselves to this mode.

If an untenable configuration is encountered, it may be that the time domain is either too long or too short to admit of operability under the present invention. However, there remains one additional variation to the geometry illustrated in FIG. 1 that may reverse a negative verdict on certain untenable configurations, which is disclosed in FIG. 12. The variant in FIG. 12 may, under certain circumstances, render a configuration tenable that was otherwise untenable, by adjusting the charge time requirements. The particular strategy embodied in FIG. 12 has particular value when there is inadequate time during a cycle to charge or discharge a given column-row crossover point. In flat panel display systems, this kind of problem arises when many hundreds of rows (perhaps several thousand) have to be addressed at an exceptionally high frame rate.

Comparing FIG. 1 with FIG. 12, there are differences as discussed below. The rows 100 of FIG. 1 are to be addressed sequentially, one at a time, and the columns 101 stretch from one end of the array to the other. The picture is quite different in FIG. 12 where the columns are split into halves. The column conductor pairs 1202 and 1203 are electrically isolated from each other due to the discontinuity between them. The same is true for subsequent pairs 1204 and 1205, 1206 and 1207, and 1208 and 1209. Consequently, the six rows 1210 through 1215 can be treated as two separate sets of rows, the three rows forming set 1200 (1210, 1211, and 1212) and the three rows forming set 1201 (1213, 1214, and 1215). Due to the electrical isolation occasioned by the halving of the columnar conductors 1202 through 1209, this configuration allows two rows to be selected at one time: one from the set 1200 and the other from the set 1201. While the likely sequence for these simultaneous (parallel) row selections would be for 1210 to activate with 1213, 1211 to activate with 1214, and 1212 to activate with 1215, the embodiment is not limited to such a pattern.

Although the ensuing parallelism is limited to this single halving for the rows, there is no limitation on parallel data loading of the columns. One driver can feed columns 1202 and 1204, another can feed 1203 and 1205, etc., if this provides benefits from the standpoint of the driver circuitry feeding the device array. However, the ultimate determining factor for the device proper is the row select sequence. Accordingly, it is evident that for an asymmetric X-Y matrix (where X does not equal Y), one should elect to halve the smaller of the two dimensions when applying the parallelism strategy of FIG. 12 to the present invention. In the case of a system with 1500 columns and 2500 rows, the rows and columns should first be reversed, so that 1500 rows are correlated to 2500 columns. The columns should then be split in two according to the depiction of FIG. 12, so that two sets of 750 rows can be driven in parallel, so that two rows at a time can be selected. Due to electrical isolation, there is no crosstalk across the electrical barrier, thereby enabling the system to perform dual row selects without garbling the data encoded onto the array. For some applications, such as the field of flat panel displays, the variation of FIG. 12 can be used to shorten a cycle if the system is otherwise tenable with respect to time domain feasibility. The resulting shorter time cycles, for pulse width modulated color as is disclosed in U.S. Pat. No. 5,319,491, may lead to significant imaging advantages with respect to human perception.

Figure 12:
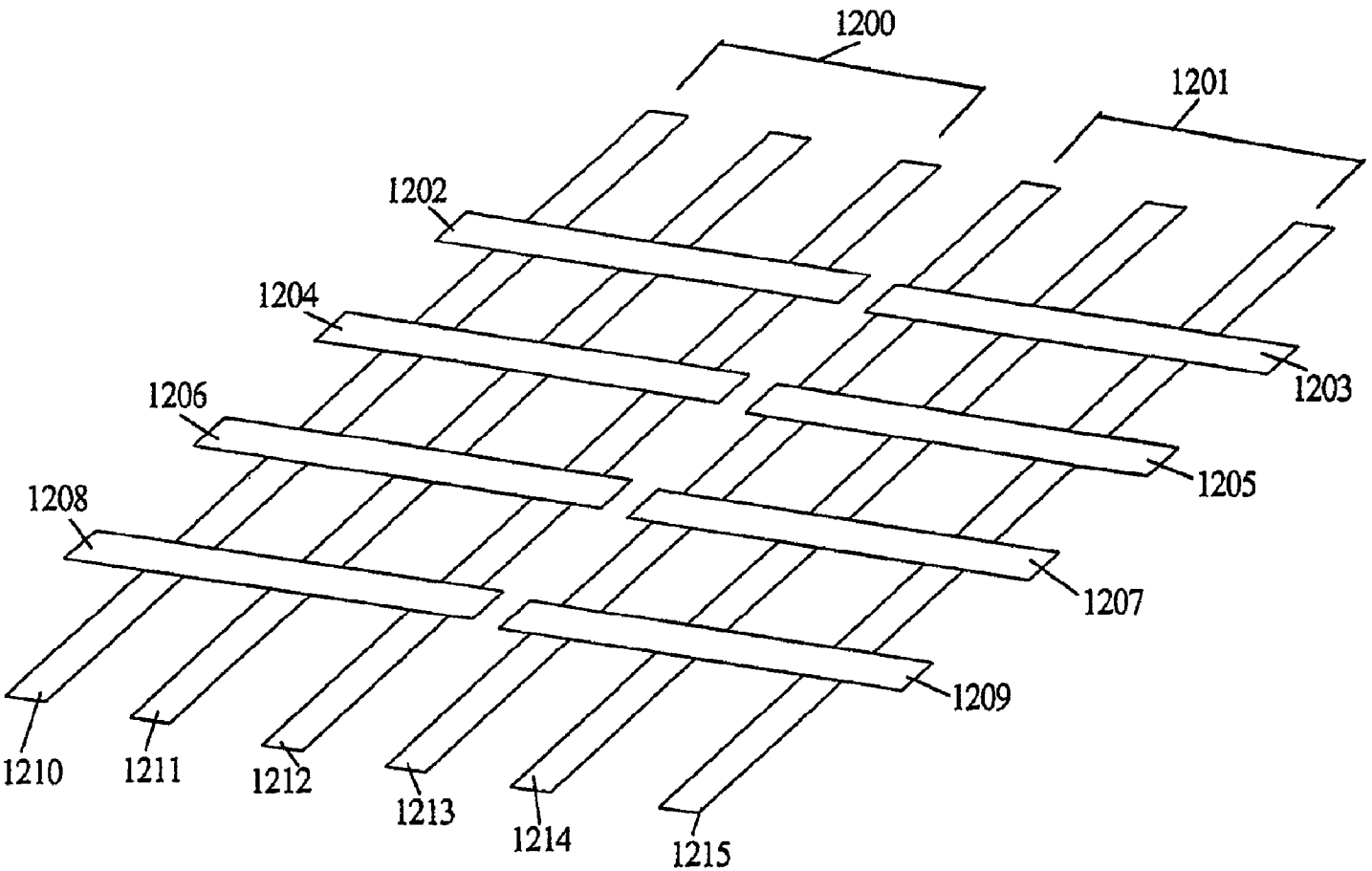
FIG. 12 illustrates drive parallelism applied to row selection, easing transient response requirements by a factor of two and enabling further parallelism in the column driver configuration in accordance with an embodiment of the present invention.

Although simple matrix addressing has been applied to flat panel displays as a primary application example, the present invention can be generalized to any device that exhibits a tenable time-domain-to-threshold relationship, as disclosed in Table 1 and further elaborated in light of the enabling variation illustrated in FIG. 12.

Finally, the thickness and/or width of the conductive columns and rows (100 and 101, or 425 through 432) need not be uniform along the length of these features. To overcome accumulated line resistance for these features, it may be desirable to increase conductor thickness and/or width as a function of distance from the point where the addressing mechanism attaches to the conductor. The present invention therefore incorporates this final variation to compensate for line resistance in systems requiring this level of tuning.

Figure 17:
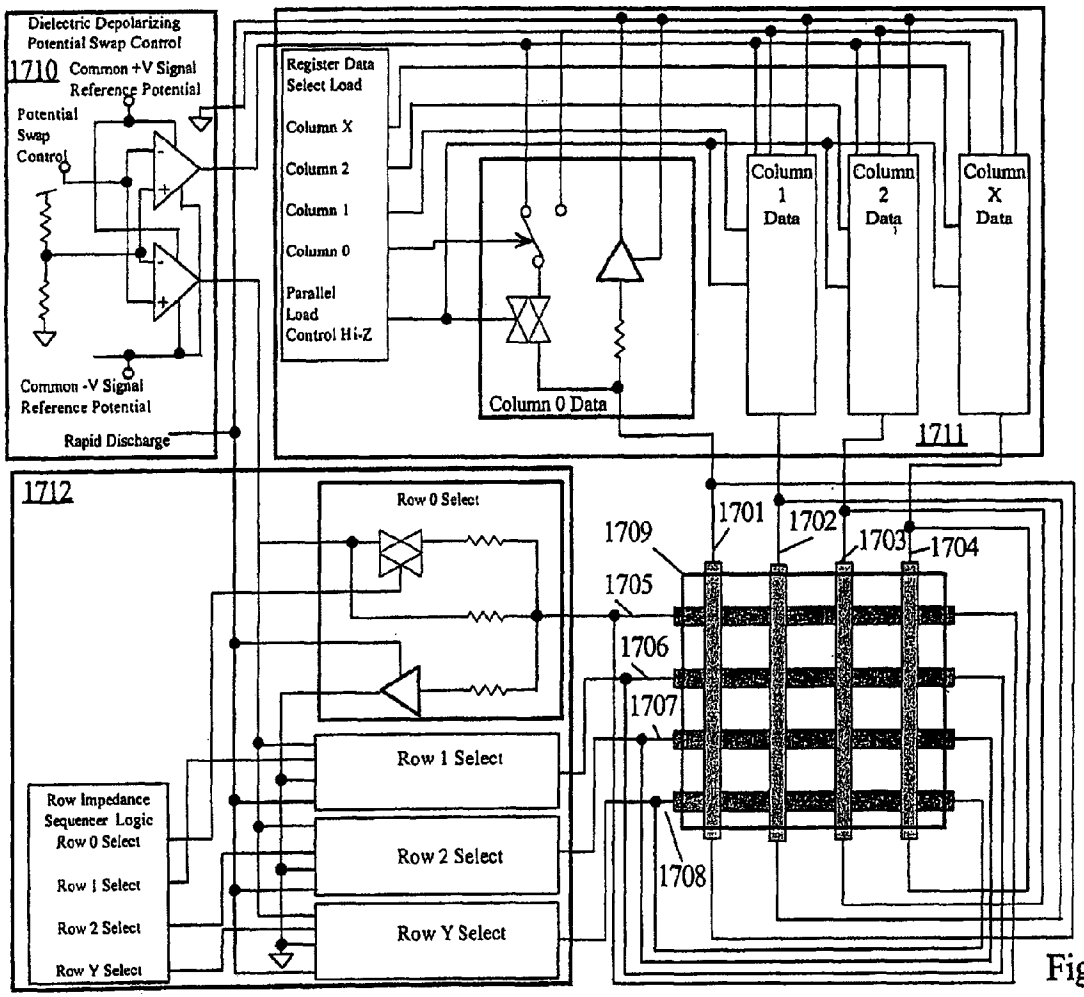
FIG. 17 illustrates a fault-tolerant, dual-drive system variant of the block diagram of FIGS. 3, 4, 5 and 6 which provides system redundancy in the case of an electrical discontinuity in one or more rows or columns in accordance with an embodiment of the present invention.

FIG. 17 discloses a variation on the fundamental drive systems of FIGS. 3, 4, 5 and 6, whereby the rows are driven at both left and right ends of the conductive trace from the common signal source, while the columns are driven in identical fashion. The main component level blocks of FIG. 17 correspond exactly with their counterparts in FIGS. 3, 4, 5, and 6 according to the following identities: block 1710 corresponds to block 310, block 433, block 510, and block 633; block 1711, which controls the columns, corresponds to the equivalent blocks at 311, 401, 511, and 601; block 1712, which controls row impedance selection, corresponds to the equivalent blocks at 300, 414, 500, and 614; while the actual X-Y matrix block 1709 corresponds to the analogous components at 312, 424, 512, and 616. The distinctive improvement this variation entails over the original topologies in FIGS. 3, 4, 5, and 6 involves the addition of the extra conductive lines 1701, 1702, 1703, and 1704 to drive the columns from both ends, and the extra conductive lines 1705, 1706, 1707, and 1708 to drive the rows from both ends. These conductive traces attach to the base topology at the rounded dot interconnect, and extend to the far side of the row or column to provide multiple connections at the distal termini thereof.

The benefit derived from this, variation is that any continuity failure in the conductive traces becomes limited as to impact, since the row (or column), being driven from both ends, becomes inherently fault-tolerant up to the break (continuity failure point) in the conductor. The distinctive features are the superadded connections 1701 through 1708 inclusive that allow the rows and columns to be driven from both ends. Note that in FIG. 17, as elsewhere, the actual dimensions of the X-Y matrix (number of columns and number of rows) is left indefinite in this disclosure, and the $4^{th}$ column and $4^{th}$ row represent the xth column and yth row throughout.

Where inter-pixel crosstalk causes leakage of applied charge to the crossover points (relative to the chosen time cycle of the target application), it is possible to provide adequate persistence at the crossover point by one of two distinct methods. These two methods, hysteresis management and variable row resistance, are discussed below.

Hysteresis management can only be applied when certain preconditions of the device are satisfied. When so satisfied, this method extends the operating domain of the present invention into application spaces that would otherwise be inaccessible due to excessive electrical crosstalk (namely, the potentially deleterious tendency for accumulated charge to equalize across any given geometric configuration of rows and columns).

The following definitions are used throughout the following detailed description of the hysteresis management method. For illustrative purposes, the pixel is treated as a parallel-plate variable capacitor in which the airgap between the plates is subject to collapse upon application of a sufficient voltage differential across the plates. The method, however, is applicable to devices where this constraint does not apply, so long as the inequalities that govern applicability are otherwise satisfied.

$V_{pull\text{-}in}$=total voltage differential applied across the pixel variable capacitor such that any $\Delta V > V_{pull\text{-}in}$ causes collapse of the air gap.

$X_{pull\text{-}in}$=the generalized displacement of the pixel variable capacitor such that for any $X > X_{pull\text{-}in}$ the displacement is no longer controllable as the capacitor plate collapses to its maximum displacement.

$\Delta V_{rel}$=the total voltage differential applied across the pixel variable capacitor such that any $\Delta V < V_{rel}$ allows the already collapsed capacitor to return to a non-collapsed position. Note that $V_{rel} < V_{pull\text{-}in}$.

$t_{row}$=the time span for which a row is considered to be addressed.

$t_{pulse}$=the time span for which the voltage is held at $V_{address\text{-}ON}$ for an addressed row that is actuating pixels to ON: by definition, $t_{pulse} \leqq t_{row}$.

Using these naming conventions, the critical voltage relationships can be more clearly specified. Before the constraints are outlined, five additional symbols to identify the required driving voltages for columns and rows need to be introduced and defined. These refer to the two voltage levels for the system columns, and the three voltage levels for the rows (noting, again, the interchangeability of these sets since such an electrical system is gauge independent).

The following definitions are used in connection with column voltage levels:

$V_{set}$=column voltage used to actuate (turn ON) a pixel when the row is in the address-ON state. When the row is in the address-OFF state, $V_{set}$ keeps the pixel in its current state.

$V_{reset}$=column voltage used to turn an ON pixel to OFF when the row is in the address-ON state. When the row is in the address-OFF state, $V_{reset}$ keeps the pixel in its current state.

The following definitions are used in connection with row voltage levels:

$V_{address\text{-}ON}$=the voltage on a row that is currently being addressed when you want to turn pixels ON. This state occurs for some fraction of every time slice, $t_{row}$.

$V_{address\text{-}OFF}$=the voltage on a row that is currently being addressed when you want to turn pixels OFF. This is like a reset mode, but can possibly selectively turn off individual pixels without the entire row being affected. This state occurs for some fraction of every time slice, $t_{row}$.

$V_{nonaddress}$=the voltage on a row that is not currently being addressed.

The eight foundational relationships (inequalities) that determine the feasibility of implementing hysteresis management follow. Any system in which all eight are satisfied would benefit from the application of hysteresis management to obtain adequate device persistence. Note that relative potential differences are the key to operation—the device is not tied to a given choice of polarity. The disclosed polarity is illustrative 1. $V_{set} - V_{address\text{-}ON} > V_{pull\text{-}in}$ (turns ON an OFF pixel in the addressed row, and refreshes an ON pixel in the addressed row)
2. $V_{set} - V_{nonaddress} < V_{pull\text{-}in}$ (keeps an OFF pixel OFF and an ON pixel ON in a non-addressed row)
3. $V_{reset} - V_{address\text{-}ON} > V_{rel}$ (leaves an ON pixel ON in the addressed row where a refresh is undesired)
4. $V_{reset} - V_{nonaddress} > V_{rel}$ (leaves an ON pixel ON and an OFF pixel OFF in a non-addressed row)
5. $V_{set} - V_{address\text{-}OFF} > V_{rel}$ (leaves an ON pixel ON in an addressed row when it is appropriate to selectively turn pixels OFF)
6. $V_{reset} - V_{address\text{-}OFF} < V_{rel}$ (turns an ON pixel to OFF, even in the middle of a time cycle if so triggered).
7. $V_{reset} - V_{address\text{-}OFF} > V_{nonaddress}$ (this keeps ON pixels ON for the time that a row is in the addressed mode such that the voltages across ON pixels in non-addressed rows do not go from positive to negative, or vice versa, thus turning those pixels OFF)
8. $V_{reset} - V_{address\text{-}ON} < V_{pull\text{-}in}$, (leaves an OFF pixel OFF in an addressed row)

The key to operation is that an addressed row is switched between $V_{address}$-ON and $V_{address\text{-}OFF}$ (or vice versa) while all other rows are at $V_{nonaddress}$. When the row is no longer being addressed, it reverts to the $V_{nonaddress}$ state. Only pixels in an addressed row can change state. The columns are nominally kept at $V_{reset}$ during the non-addressed state. An addressed row will go from a $V_{nonaddress} \rightarrow V_{address\text{-}ON} \rightarrow V_{address\text{-}OFF} \rightarrow V_{nonaddress}$ before moving to the next row. This order of row switching is preferred since it allows an ON pixel to be refreshed without ever going OFF. If the order of row switching is $V_{nonaddress} \rightarrow V_{address\text{-}OFF} \rightarrow V_{address\text{-}ON} \rightarrow V_{nonaddress}$, slight timing differences associated with the voltage level changes on the rows and columns may arise.

When a row is in an addressed-ON state, for a pixel to turn ON, its corresponding column is switched to $V_{set}$ for some pulse time which is shorter than $t_{row}$. For a pixel to remain in its current OFF state while its row is at addressed-ON, its corresponding column is left at $V_{reset}$.

When a row goes to the addressed-OFF state, for an ON pixel to turn OFF, its corresponding column is switched to (or kept at) $V_{reset}$ for some pulse time that is shorter than the $t_{row}$. For a pixel to remain in its current ON state while its row is at addressed-OFF, its corresponding column is kept at Vset. If a pixel is OFF before the addressed-OFF state, then either Vset or Vreset will keep it in the OFF state, but the most robust control is achieved by keeping an OFF pixel at Vreset.

The implications of this hysteresis management method are such that any row must be switched between three different states each time it is addressed: $V_{address\text{-}ON}$, $V_{address\text{-}OFF}$, and $V_{nonaddress}$. Also, while a column is addressed in this sequence, any given column may be set to $V_{set}$ (for refresh or to turn an OFF pixel to ON) or $V_{reset}$ (to remain in an OFF state or make an ON pixel turn OFF). The disclosed method exploits the differential voltage arising between the rows and columns that obtains during the course of these manipulations of the row and column potentials.

Figure 18:
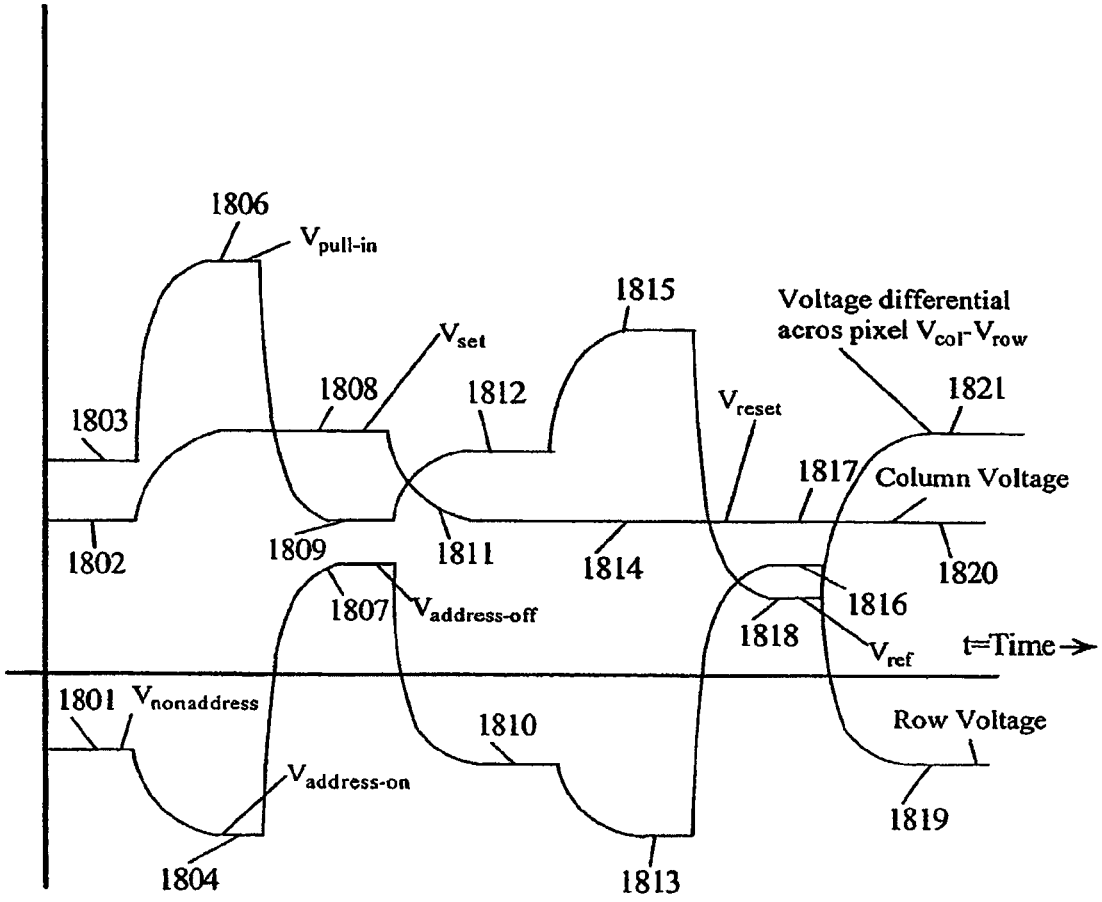
FIG. 18 illustrates representative threshold voltages for rows and columns required for implementing hysteresis management to attain signal persistence and attenuate inter-pixel crosstalk in accordance with an embodiment of the present invention.

In FIG. 18, row voltages travel between three different levels corresponding to $V_{address\text{-}ON}$, $V_{address\text{-}OFF}$, and $V_{nonaddress}$. From left to right (moving forward in time, which is represented by the horizontal axis), a row begins at $V_{nonaddress}$ (1801). As the row is addressed (selected), its voltage moves to $V_{address\text{-}ON}$ (1804), which is necessary (although not sufficient) to activate a pixel. The potential value finally shifts to $V_{address\text{-}OFF}$ (1807), which is necessary (although not sufficient) for deactivating a pixel. Whether the pixel activates or deactivates depends on the column voltage. There are three scenarios as illustrated in FIG. 18: activation and on-state persistence of a pixel (as the row voltages moves from 1801 to 1804 to 1807); state persistence (whether on or off) of a pixel (as the row voltages move from 1810 to 1813); and deactivation of a pixel (as the row voltage moves to 1816). These are explained in more detail below, which explains the interaction of these row voltage values with the column voltages (corresponding to the loaded data being encoded on the matrix).

It is noted that an inactive pixel will not activate unless the differential voltage reaches $V_{pull\text{-}in}$, which in FIG. 18 only occurs at 1806. An activated pixel will remain activated until the differential voltage reaches $V_{rel}$, which occurs only at 1818. FIG. 18 illustrates the behavior of the pixel (or other general criteria-compliant device at each X-Y crossover) for each set of possible inputs, thereby demonstrating the utility of the disclosed switching system. As such, FIG. 18 illustrates the various-permutations of the two column voltage values and three row voltage values, tracking the differential voltage in each case. It is needful to step through each of these combinations seriatim.

Prior to selection, a row is in a non-addressed state 1801, while the column voltage reflects the absence of data 1802, leading to an initial differential voltage 1803. Next, the row is selected 1804 while the column data becomes non-zero (presupposing a 1 instead of a 0 in the data being loaded onto this representative column), at 1808. Under this circumstance, the differential voltage rises to 1806, which forces the pixel to activate. Note, however, the important result where a row is in a non-addressed state 1810. Even if the column voltage is non-zero 1808, the differential voltage is at 1809, which means the existing state of the pixel will remain unchanged—if it is on, it will remain on (since the differential voltage is higher than the release voltage 1818) and if it is off, it will remain off (since the differential voltage is lower than the activation voltage 1806). If one regards FIG. 18 as representing events linearly in time from left to right, that would mean that after the activation threshold is satisfied at 1806, the switching of the row to a non-addressed state 1807 means the pixel remains activated since the prevailing differential voltage 1809 is higher than the release voltage 1818. Moreover, the pixel may remain in the on state until two criteria are simultaneously satisfied: the column voltage is at a value 1817 while the rows are in an address-off state 1816. This alone drops the differential voltage to the required level to release and deactivate the pixel 1818.

It should be understood and appreciated that the exigencies of driver encoding may well entail the postponement of the address-off row event to the end of a given data cycle, as opposed to that event occurring multiple times per data encoding event. In FIG. 18, that would mean that the row voltages would move between non-address and address-on states without reaching an address-off state until after all pixel values for a given time domain are set. Specifically, the row voltages would move from 1801 to 1804 to 1810 (skipping the transition to 1807) to 1813, etc. The shift to the address-off state (shown at 1807 and 1816) would be postponed until necessary; until then, the rows could oscillate between two states (1801 to 1804 to 1810 to 1813 to 1819, etc.). The present invention is not tied to any specific strategy as to when or how often the row address-off event is triggered, nor does it argue for redundant triggering if there are reasons to consolidate the address-off event temporally.

Consider a situation where the pixel is activated at 1806, but the address-off event 1807 is suppressed (postponed till later). Once the column voltage drops to 1811 (while the row voltage migrates from 1804 directly to 1810, skipping 1807), the pixel remains in an on state since differential voltage at 1812 is still too high to permit release (deactivation). Assume for illustrative purposes that the pixels were previously set in an off-state. The conjunction of this column off-state, 1814, with a row address-on event at 1813, leads to a differential voltage 1815 that is still too low to activate the pixel, which is the desired result in this case.

After a release (deactivation) event that occurs when the differential voltage reaches 1818, the system effectively resets, and the row resumes its next state change to a non-address state 1819, with the column off-state pegged at 1820, leading to a differential voltage 1821 consistent with the quiescent state. Therefore, different parts of FIG. 18 fully illustrate the key functionalities of the disclosed system, depending on the assumption of the initial state of a given pixel, or (more importantly) where, horizontally, one assumes the cycle to begin (e.g., at 1810, as opposed to 1801, illustrating behaviors for a situation where the column value is initially encoded as being in an off state). FIG. 18, after a fashion, serves as a general nomograph of device behavior in terms of the conditions that trigger desired state changes and/or state persistence at each pixel (X-Y crossover point in the matrix).

It should be noted that the lower the ratio of $V_{rel}/V_{pull\text{-}in}$, (the value at 1818 divided by that at 1806), the more robust the control scheme. Because there is greater distinction between turning off a pixel and turning it on, greater variations in the voltages applied to the rows and columns can be tolerated without error. Such variations in voltages could arise out of resistive losses along the conductive traces, so that tuning the system to withstand such variations renders it more stable as a decoding transducer.

The tuning of any given X-Y matrix, first to satisfy and then to optimize these requirements, may require adjustments to the mechanical and/or electromechanical behavior of the device being actuated/activated at the crossover point (pixel). One case in point is the device disclosed in U.S. Pat. No. 5,319,491, which does not actually behave as a conventional parallel-plate variable capacitor since its "plates" are not rigid. The modifications to that system to render it suitable for hysteresis management may entail methods to increase rigidity to its otherwise compliant movable upper "plate," or otherwise alter its mechanical and geometrical profile during activation and deactivation (such as by removing a portion of the column or row conductor at the center of each X-Y crossover point to alter a pixel's activation behavior—in effect, a hole in the conductive trace). The present invention will provide suitable persistence enhancement whenever the behavior adjustments have been made to satisfy the eight inequalities described in the preceding text.

An alternative method to secure device persistence at the X-Y crossovers as a function of the fundamental time cycle of the target application is to globally change the resistance of the entire row, which is electrically equivalent to interposing variable resistors on each row between each column. In lieu of fabricating a large quantity of inter-column resistors on each row (each requiring separate control mechanisms), it may be simpler to fabricate the row out of a material that is capable of changing its fundamental resistance by many orders of magnitude (which can be switched between resistance states globally by application of an appropriate electrical signal, e.g., in the transverse direction). Such a method is disclosed in FIG. 19. Note that hysteresis management may be obviated by implementing such a mechanism; the assumption that this is the case will be assumed to hold true for the discussion to follow. Accordingly, the discussion only acknowledges two voltage values on the rows, as opposed to the three distinct values required to implement the hysteresis management approach illustrated in FIG. 18.

Adoption of this method assumes the use of a row material that can change its resistance by several (3-6) orders of magnitude. Doped perovskites, among other candidates, reportedly possess the requisite properties (with published switching times below 100 nanoseconds exhibiting resistance swings up to 6 orders of magnitude). The present invention is not limited to the use of current doped perovskite materials, but embraces all materials that exhibit the required properties.

The minimum required resistance swing will depend upon final matrix size (number of rows and columns), the ratio factor generally falling in the range between $10^3$ and $10^7$. The required change in resistance has been shown to scale linearly with the product $N_{col}N_{row}$, where $N_{col}$ is the number of columns and $N_{row}$ is the number of rows in any given system being driven by the present invention.

This control design essentially limits the rate at which pixels charge and discharge with respect to one another (inter-pixel crosstalk/leakage). A constant voltage is applied to both the rows and columns, $V_{row}$ and $V_{col}$, respectively such that $|V_{col}-V_{row}|>V_{pull\text{-}in}$. Here, the naming conventions established in the prior discussion of hysteresis management still apply. When a row is addressed, its trace resistance is globally (i.e., throughout its entire length) changed to a low value so that all of the necessary pixels can be charged sufficiently. The mechanism 1913 for selectively imposing the desired resistance change globally across the entire surface area of a given row is synchronized with the trailing edge of the row address state. Further, the mechanism 1913 is generalized in the present invention, since this method is not tied to any specific or narrowly-defined approach to swinging the resistance value of the entire row. All of the non-addressed rows would be set to have a low resistance along their lengths. The sequence of events that occur, during the time a row is addressed ($t_{row}$), would be as follows:

1) The active columns are set to have resistance $R_{C,low}$ (~100 kΩ).
2) The inactive columns are set to have resistance $R_{C,high}$ (~100 MΩ).
3) The variable resistor material comprising the addressed row trace is put in a low resistance state, $R_{R,row}$.
4) All pixels in the addressed row with $R_{C,low}$ on their column charge very quickly. All pixels in the addressed row with $R_{C,high}$ on their column charge at a rate too slow to activate a pixel during the relevant cycle time.
5) The variable resistor material comprising the addressed row is placed in a high resistance state, $R_{R,high}$.
6) The preceding sequence (1) through (5) is repeated again for the next addressed row until all rows have been addressed.

This method provides time cycle-appropriate suppression of inter-pixel crosstalk, thereby obtaining adequate device persistence by extending the RC time constant to the inter-pixel domain.

Figure 19:
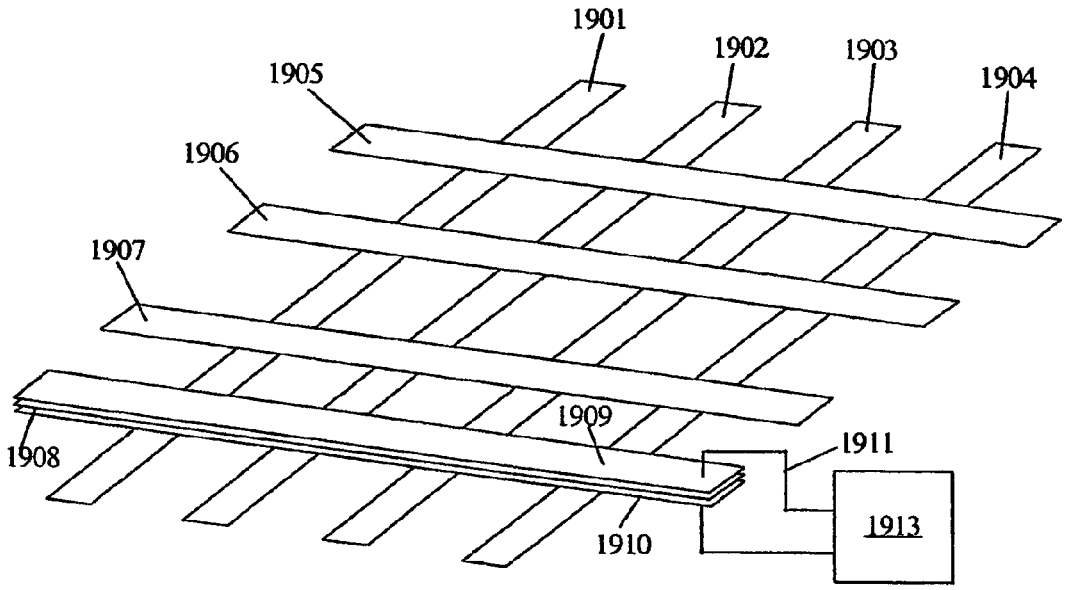
FIG. 19 illustrates a method to implement global resistance control along each row of an X-Y matrix system to provide suitable attenuation of inter-pixel crosstalk and thereby enhance device persistence in accordance with an embodiment of the present invention.

The implementation of one representative embodiment of this variation on the core invention is illustrated in FIG. 19. A four by four square matrix is used as a surrogate for any arbitrarily sized X by Y matrix. Conductive columns 1901, 1902, 1903, and 1904 correspond to the same column structures 100 in FIG. 1, the respective columns 326, 327, 328, and 329 in FIG. 3, and all analogous column structures elsewhere disclosed in this document, without limitation. The columns in FIG. 19 are unchanged from their counterparts elsewhere in this document. The rows in FIG. 19 (namely, 1905, 1906, 1907 and 1908) are modified from their counterparts elsewhere in this disclosure (e.g., the rows drive at 301, 302, 303, and 304). The nature of this modification is only shown in the case of row 1908, where it is presupposed in this case that the desired resistance-shifting effect is caused by the selective application and removal (or reversal) of a transverse electrical field (a field perpendicular to the plane on which 1905, 1906, 1907, and 1908 lie, which intersects the surface of 1908). This mechanism is selected for illustrative purposes since the present invention will operate equally well if an alternate mechanism yields identical resistance-shifting behavior in any row it is applied to, such as 1908.

The mechanism used in this example for causing the desired resistance shift in 1908 is a set of parallel electrodes 1909 and 1910 disposed on opposite surfaces of the row conductor 1908. These are attached via conductive traces 1911 and 1912 to the selectively controllable voltage source 1913. When 1913 is switched on, the appropriate potential difference is applied between 1909 and 1910, thereby setting up the requisite transverse electrical field that causes conductor 1908 to shift its resistance value. It is understood that practitioners skilled in the art, and understanding the requirements for securing the desired behavior from row conductor 1908, which is itself made out of a special material that responds appropriately to the applied field, would be able to properly configure and fabricate the means suited to controlling the resistance shift phenomenon being herein exploited.

Finally, the triggering and selective control of device 1913, and its counterparts which are associated with all the other rows in the matrix (not shown in FIG. 19) is to be synchronized with the row select signal being propagated by the core device. When a row is being selected (i.e., placed in a low impedance state, as explained throughout this disclosure in reference to FIGS. 3, 4, 5, and 6), the associated device (e.g., 1913) must itself place the selected row in a low impedance state globally. As the row becomes unselected, the devices of which 1913 is an exemplar must trigger to cause the targeted row to globally shift into a high impedance state. This will slow down all leakage or crosstalk within the row, thereby generating adequate persistence for utilizing the present invention in applications that would otherwise be inappropriate. Therefore, this method, like hysteresis management, expands the application range of the present invention. It may even be possible to treat the desired effect created by 1913 with respect to the associated row as a suitable replacement, partially or wholly, of any parallel functionality already disclosed for the present invention.

Figure 22:
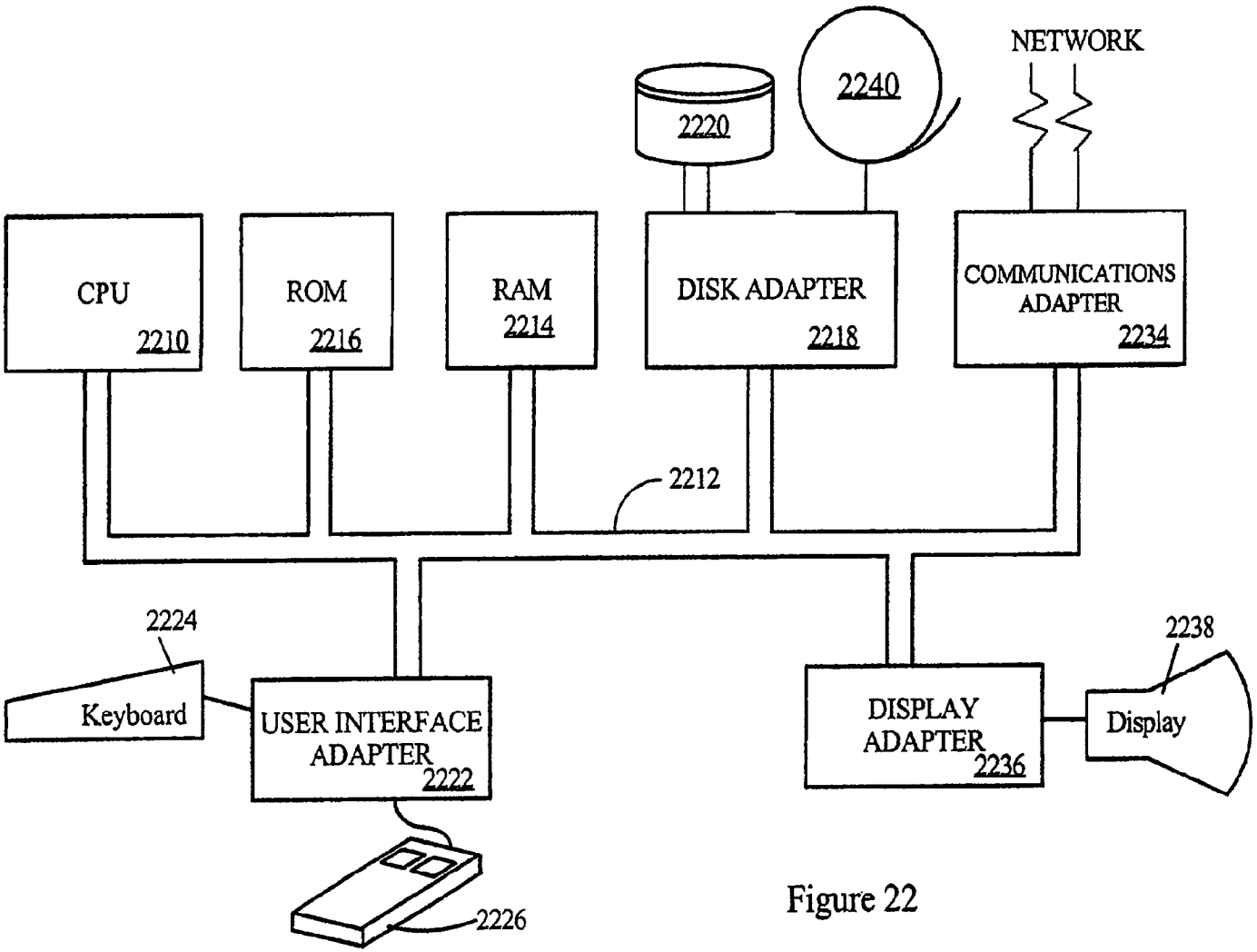
FIG. 22 illustrates a data processing system configurable in accordance with the present invention.

A representative hardware environment for practicing the present invention is depicted in FIG. 22, which illustrates an exemplary hardware configuration of data processing system 2213 in accordance with the subject invention having central processing unit (CPU) 2210, such as a conventional microprocessor, and a number of other units interconnected via system bus 2212. Data processing system 2213 includes random access memory (RAM) 2214, read only memory (ROM) 2216, and input/output (I/O) adapter 2218 for connecting peripheral devices such as disk units 2220 and tape drives 2240 to bus 2212, user interface adapter 2222 for connecting keyboard 2222, mouse 2226, and/or other user interface devices such as a touch screen device (not shown) to bus 2212, communication adapter 2234 for connecting data processing system 2213 to a data processing network, and display adapter 2236 for connecting bus 2212 to display device 2238. Display device 2238 may implement any of the embodiments described herein. Any of the displays described herein may include pixels such as shown in FIGS. 21A and 21B. CPU 2210 may include other circuitry not shown herein, which will include circuitry commonly found within a microprocessor, e.g., execution unit, bus interface unit, arithmetic logic unit, etc. CPU 2210 may also reside on a single integrated circuit.

What is claimed is:

1. A system comprising:

a matrix of control lines comprising first control lines extending in a first direction and second control lines extending in a second direction, different from said first direction, wherein said first control lines and said second control lines intersect to form crossover points in said matrix of control lines;

a first device electrically coupled to the first control lines and configured to change an in-line impedance state of select ones of said first control lines from a high impedance state to a low impedance state and to apply a respective first drive voltage to each of said first control lines;

a second device electrically coupled to the second control lines and configured to apply a respective second drive voltage to each of said second control lines; and a matrix of optical shutters comprising a light guidance substrate and a deformable elastomer layer, each one of the optical shutters being at a respective one of said crossover points;

wherein for each crossover point, the optical shutter at said crossover point is activated when the respective first control line is in the low impedance state and a differential voltage between the second drive voltage on the respective second control line and the first drive voltage on the respective first control line increases in magnitude to traverse an activation threshold voltage for the optical shutter such that the deformable elastomer layer changes in shape from an original shape to a deformed shape at the optical shutter and light propagating in the light guidance substrate is coupled out from the light guidance substrate at the optical shutter.

2. The system of claim 1 wherein said first control lines comprise a material exhibiting a change in electrical resistivity greater than a factor of 1000 under application of an electrical signal.

3. The system of claim 2 wherein said material comprises a doped perovskite.

4. The system of claim 2 further comprising:

a first electrode and a second electrode disposed on opposite sides of one of said first control lines; and a selectively controllable voltage source to apply the electric signal between said first electrode and said second electrode.

5. The system of claim 1 wherein said select ones of said first control lines is a single one of said first control lines.

6. The system of claim 1 wherein said select ones of said first control lines are all of said first control lines.

7. The system of claim 1 wherein for each one of the optical shutters, the first device and the second device are additionally configured to reverse a polarity of the respective differential voltage.

8. The system of claim 1, wherein the first device is additionally configured to: change the in-line impedance state of those first control lines in the low impedance state other than the select ones of said first control lines from the low impedance state to the high impedance state; and maintain the in-line impedance state of those first control lines in the high impedance state other than the select ones of said first control lines in the high impedance state.

9. The system of claim 1, wherein for each crossover point, the optical shutter at said crossover point is deactivated when the respective first control line is in the low impedance state and the differential voltage decreases in magnitude to traverse a deactivation threshold voltage for the optical shutter such that the deformable elastomer layer changes in shape from the deformed shape to the original shape at the optical shutter.

10. The system of claim 9 wherein for at least some of the optical shutters, the deactivation threshold voltage is smaller than the respective activation threshold voltage.

11. The system of claim 1, wherein: the first device is additionally configured to:

change the in-line impedance state of those first control lines in the high impedance state from the high impedance state to the low impedance state; and maintain the in-line impedance state of those first control lines in the low impedance state in the low impedance state; and the first device and second device are additionally configured to apply the respective first drive voltages and the respective second drive voltages such that the differential voltage at each crossover point is less than the deactivation threshold voltage for the respective optical shutter.

12. The system of claim 1, wherein the first device is additionally configured to change the in-line impedance state of the select ones of said first control lines from the low impedance state to the high impedance state.

* * * * *